US009593488B2

(12) United States Patent
Rasmussen et al.

(10) Patent No.: US 9,593,488 B2
(45) **Date of Patent: *Mar. 14, 2017**

(54) MODULAR ROOF PANEL WITH INTEGRATED DRAINAGE SYSTEM

(71) Applicant: CERTAINTEED CORPORATION, Malvern, PA (US)

(72) Inventors: Craig Scott Rasmussen, Ada, MI (US); Donald Mark Wilkinson, Holland, MI (US); Marc Richard Spetoskey, Allendale, MI (US); Mark Allen Bredeweg, Zeeland, MI (US); Nick Kooyer, Grand Rapids, MI (US); Mark Armock, Grand Haven, MI (US); Brad Walbridge, Hudsonville, MI (US); Austin Harms, Grand Rapids, MI (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/991,101

(22) Filed: Jan. 8, 2016

(65) Prior Publication Data

US 2016/0123013 A1 May 5, 2016

Related U.S. Application Data

(63) Continuation of application No. 14/874,747, filed on Oct. 5, 2015, which is a continuation of application (Continued)

(51) Int. Cl.

*E04B 1/70* (2006.01)
*E04F 17/00* (2006.01)

(Continued)

(52) U.S. Cl.

CPC ..... *E04D 1/265* (2013.01); *E04B 1/40* (2013.01); *E04C 2/08* (2013.01); *E04D 1/30* (2013.01);

(Continued)

(58) Field of Classification Search

CPC ..... E04D 1/265; E04D 13/0404; E04D 2001/3414; E04D 2001/3461; E04D 2001/3494; E04B 1/40

(Continued)

(56) References Cited

U.S. PATENT DOCUMENTS

| | | | |
|---|---|---|---|
| 996,750 | A | 7/1911 | Dolph |
| 1,434,166 | A | 10/1922 | Thompson |

(Continued)

FOREIGN PATENT DOCUMENTS

| | | |
|---|---|---|
| WO | 9705345 | 2/1997 |
| WO | 2006005339 | 1/2006 |

*Primary Examiner* — Joshua J Michener
*Assistant Examiner* — Keith Minter
(74) *Attorney, Agent, or Firm* — Abel Law Group, LLP; Alexander H. Plache

(57) ABSTRACT

A roof panel includes a planar body having top and bottom edges, with a downturn edge extending therebetween, and an opposing channel edge. The downturn edge overlays a channel edge of an adjacent panel. The bottom edge overlays a top edge of another adjacent panel. A plurality of courses extends between the channel and downturn edges. Each course includes a nesting ridge to receive the downturn edge of an adjacent panel and to position a top surface of the panel flush with adjacent panels. Surface channels and contoured ridges are defined within each course. A drain aperture of the drip edge aligns with an adjacent channel edge to direct material through the drain aperture and onto adjacent panels. A gable member engages an edge when the panel has one or (Continued)

fewer laterally adjacent panels, wherein the gable member is flush with the adjacent planar body.

20 Claims, 28 Drawing Sheets

Related U.S. Application Data

No. 14/687,149, filed on Apr. 15, 2015, now Pat. No. 9,181,702, which is a continuation of application No. 14/605,159, filed on Jan. 26, 2015, now Pat. No. 9,097,019.

(60) Provisional application No. 61/934,277, filed on Jan. 31, 2014, provisional application No. 62/008,774, filed on Jun. 6, 2014, provisional application No. 62/040,752, filed on Aug. 22, 2014.

(51) Int. Cl.

| | |
|---|---|
| ***E04D 1/26*** | (2006.01) |
| ***E04B 1/41*** | (2006.01) |
| ***E04D 13/04*** | (2006.01) |
| ***E04D 1/34*** | (2006.01) |
| ***E04D 1/30*** | (2006.01) |
| ***E04C 2/08*** | (2006.01) |

(52) U.S. Cl.
CPC ..... *E04D 1/34* (2013.01); *E04D 13/0404* (2013.01); *E04D 1/3402* (2013.01); *E04D 13/0445* (2013.01); *E04D 2001/302* (2013.01); *E04D 2001/305* (2013.01); *E04D 2001/3414* (2013.01); *E04D 2001/3461* (2013.01); *E04D 2001/3494* (2013.01); *E04D 2013/045* (2013.01)

(58) Field of Classification Search
USPC ..... 52/302.1
See application file for complete search history.

(56) References Cited

U.S. PATENT DOCUMENTS

| | | | | |
|---|---|---|---|---|
| 1,460,795 | A | 7/1923 | Harshberger | |
| 1,579,693 | A | 4/1926 | Finkeldey et al. | |
| 1,583,969 | A | 5/1926 | Greenstreet | |
| 1,589,675 | A | 6/1926 | Belding | |
| 1,609,127 | A | 11/1926 | Rachlin | |
| 1,775,930 | A | 9/1930 | Bosquet | |
| 2,004,198 | A | 6/1935 | Fall | |
| 2,178,357 | A | 10/1939 | Hoess | |
| 2,188,454 | A | 1/1940 | Braddock | |
| 2,209,704 | A | 7/1940 | Olden | |
| D161,210 | S | 12/1950 | Ruggles | |
| 2,811,118 | A | 10/1957 | Ball | |
| 3,058,265 | A | 10/1962 | Lapsensohn | |
| 3,253,376 | A * | 5/1966 | Straus | E04C 2/322 52/394 |
| 3,363,380 | A | 1/1968 | Merrill | |
| 3,412,517 | A | 11/1968 | Ellis et al. | |
| 3,593,479 | A | 7/1971 | Hinds et al. | |
| 3,605,369 | A | 9/1971 | Merrill et al. | |
| 3,667,184 | A | 6/1972 | Merrill et al. | |
| 3,862,532 | A | 1/1975 | Markos | |
| 3,897,667 | A | 8/1975 | Turek | |
| 3,977,141 | A | 8/1976 | Peters | |
| 3,990,206 | A * | 11/1976 | Reusser | E04D 3/365 52/521 |
| 4,001,997 | A | 1/1977 | Saltzman | |
| 4,015,391 | A | 4/1977 | Epstein et al. | |
| D256,953 | S | 9/1980 | Morita | |
| D256,954 | S | 9/1980 | Morita | |
| 4,279,106 | A | 7/1981 | Gleason et al. | |
| 4,343,126 | A | 8/1982 | Hoofe, III | |
| 4,598,522 | A | 7/1986 | Hoofe, III | |
| 4,680,911 | A | 7/1987 | Davis et al. | |
| 4,736,565 | A | 4/1988 | Bisson | |
| 5,072,562 | A | 12/1991 | Crick et al. | |
| 5,174,092 | A | 12/1992 | Naden | |
| 5,249,402 | A | 10/1993 | Crick et al. | |
| 5,339,608 | A | 8/1994 | Hollis et al. | |
| 5,455,099 | A | 10/1995 | Banner | |
| 5,469,680 | A | 11/1995 | Hunt | |
| 5,533,313 | A | 7/1996 | Pike et al. | |
| 5,537,791 | A | 7/1996 | Champagne | |
| 5,537,792 | A | 7/1996 | Moliere | |
| 5,606,835 | A | 3/1997 | Champagne | |
| 5,613,337 | A | 3/1997 | Plath et al. | |
| 5,622,020 | A | 4/1997 | Wood | |
| 5,634,314 | A | 6/1997 | Champagne | |
| 5,644,886 | A | 7/1997 | Ekmark et al. | |
| 5,685,117 | A | 11/1997 | Nicholson | |
| 5,722,212 | A | 3/1998 | Struve et al. | |
| 5,738,462 | A | 4/1998 | Petersen et al. | |
| D394,718 | S | 5/1998 | Costantini | |
| D394,719 | S | 5/1998 | Costantini | |
| 5,752,355 | A | 5/1998 | Sahramaa | |
| D410,094 | S | 5/1999 | Hedges et al. | |
| D410,095 | S | 5/1999 | Hedges et al. | |
| D414,568 | S | 9/1999 | Hedges et al. | |
| D415,848 | S | 10/1999 | Plath et al. | |
| 6,004,065 | A | 12/1999 | Higdon et al. | |
| 6,052,961 | A | 4/2000 | Gibbs | |
| 6,173,546 | B1 | 1/2001 | Schafer | |
| D441,881 | S | 5/2001 | Hahn | |
| 6,269,603 | B1 | 8/2001 | Ross | |
| D449,897 | S | 10/2001 | Croft | |
| 6,298,625 | B1 | 10/2001 | Sweet | |
| D462,129 | S | 8/2002 | Sadosky, Jr. et al. | |
| 6,557,315 | B2 | 5/2003 | Tremblay | |
| RE38,210 | E | 8/2003 | Plath et al. | |
| 6,857,239 | B2 | 2/2005 | Sadosky, Jr. et al. | |
| 6,955,019 | B2 | 10/2005 | Donlin et al. | |
| 7,168,215 | B1 | 1/2007 | Bednarczyk | |
| 7,246,474 | B2 | 7/2007 | Dombek et al. | |
| 7,331,150 | B2 | 2/2008 | Martinique | |
| 7,581,364 | B2 | 9/2009 | Godby | |
| 7,775,009 | B2 | 8/2010 | King | |
| 7,788,874 | B2 | 9/2010 | Miller, Jr. | |
| D629,924 | S | 12/2010 | Cornett | |
| D636,502 | S | 4/2011 | Hudson, Jr. et al. | |
| D637,317 | S | 5/2011 | Hudson, Jr. et al. | |
| D643,133 | S | 8/2011 | Steffes et al. | |
| D644,342 | S | 8/2011 | Hudson, Jr. et al. | |
| D644,754 | S | 9/2011 | Hudson, Jr. et al. | |
| D644,755 | S | 9/2011 | Hudson, Jr. et al. | |
| D648,040 | S | 11/2011 | Hudson, Jr. et al. | |
| D650,920 | S | 12/2011 | Hudson, Jr. et al. | |
| D650,921 | S | 12/2011 | Hudson, Jr. et al. | |
| D650,922 | S | 12/2011 | Hudson, Jr. et al. | |
| D650,923 | S | 12/2011 | Hudson, Jr. et al. | |
| D653,361 | S | 1/2012 | Hudson et al. | |
| 8,151,534 | B1 | 4/2012 | Green et al. | |
| 2003/0121217 | A1 * | 7/2003 | Grizenko | E04D 3/40 52/60 |
| 2004/0000334 | A1 * | 1/2004 | Ressler | F24J 2/5211 136/251 |
| 2005/0072091 | A1 | 4/2005 | Morris | |
| 2007/0137132 | A1 | 6/2007 | Plowright | |
| 2011/0036037 | A1 | 2/2011 | King | |
| 2012/0312373 | A1 | 12/2012 | Hudson, Jr. et al. | |

* cited by examiner

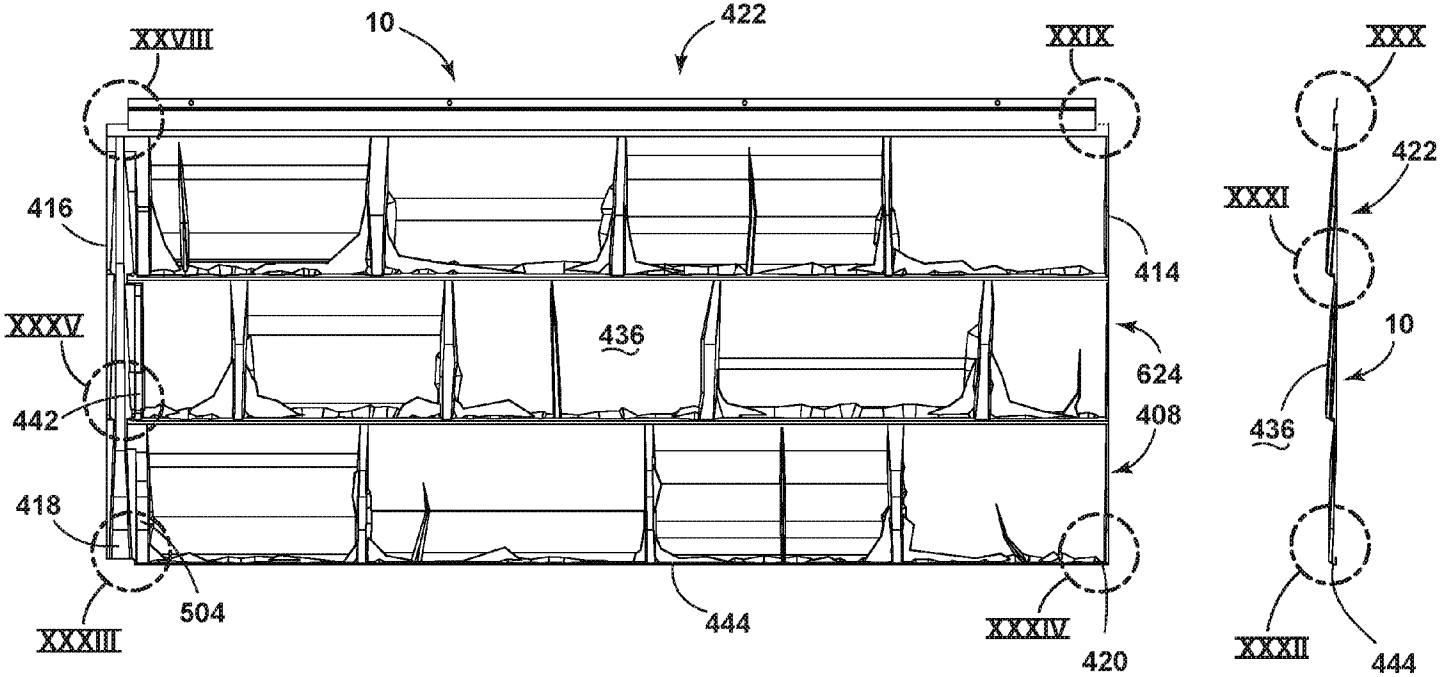
FIG. 27
FIG. 25
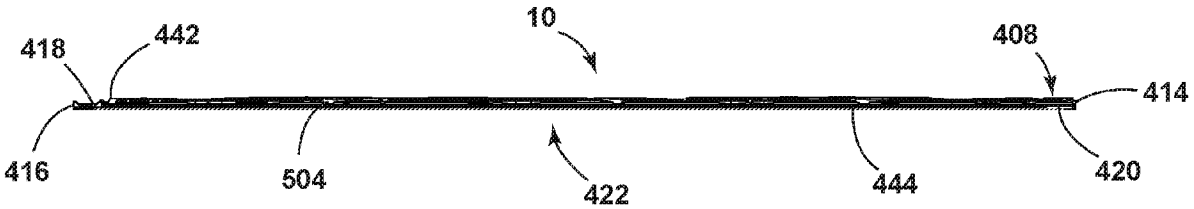
FIG. 26

MODULAR ROOF PANEL WITH INTEGRATED DRAINAGE SYSTEM

CROSS-REFERENCE TO RELATED APPLICATION

This application is a continuation of U.S. patent application Ser. No. 14/874,747, filed on Oct. 5, 2015, entitled "MODULAR ROOF PANEL WITH INTEGRATED DRAINAGE SYSTEM," which is a continuation of U.S. patent application Ser. No. 14/687,149, filed on Apr. 15, 2015, entitled "MODULAR ROOF PANEL WITH INTEGRATED DRAINAGE SYSTEM," now U.S. Pat. No. 9,181,702, which is continuation of U.S. patent application Ser. No. 14/605,159, filed on Jan. 26, 2015, entitled "MODULAR ROOF PANEL WITH INTEGRATED DRAINAGE SYSTEM," now U.S. Pat. No. 9,097,019, which claims priority to and the benefit under 35 U.S.C. §119(e) of U.S. Provisional Patent Application No. 61/934,277, filed on Jan. 31, 2014, entitled "MODULAR ROOF PANEL WITH INTEGRATED DRAINAGE SYSTEM," and of U.S. Provisional Patent Application No. 62/008,774, filed on Jun. 6, 2014, entitled "DRAINAGE COMPATIBLE ATTACHMENT CLIP FOR INTERLOCKING METAL ROOFING PANEL SYSTEMS," and of U.S. Provisional Patent Application No. 62/040,752, filed on Aug. 22, 2014, entitled "CLIP RECEIVING POCKET FOR METAL ROOFING PANEL," the entire disclosures of which are hereby incorporated herein by reference.

FIELD OF THE INVENTION

The present invention generally relates to modular roofing panels, and more specifically, modular roofing panels that incorporate an internal drainage system.

SUMMARY

In at least one aspect, an interlocking roofing panel system for a roof structure includes a plurality of roofing panels, each of the plurality of roofing panels including first and second side edges, a drain channel positioned proximate the first side edge, and a drain-concealing portion positioned proximate the second side edge, a first laterally adjacent roof panel of the plurality of roofing panels, a second laterally adjacent roof panel of the plurality of roofing panels, wherein the second side edge of the second laterally adjacent roof panel is selectively disposed over the drain channel of the first laterally adjacent roof panel, an adjacent downhill roof panel of the plurality of roofing panels positioned under at least a portion of the first and second laterally adjacent roof panels, wherein the drain channel of the first laterally adjacent roof panel is in communication with the second side edge of the second laterally adjacent roof panel and a top surface of the adjacent downhill roof panel and an attachment clip positioned under the second side edge of the second laterally adjacent roof panel and over the drain channel of the first laterally adjacent roof panel, and wherein the attachment clip includes a bridge portion that spans over the drain channel of the first laterally adjacent roof panel and a compression section that engages a receiving area defined within an upper surface of the first laterally adjacent roof panel.

In at least another aspect, an interlocking metal roofing panel system includes a plurality of metal roofing panels, each having first and second side edges, a drain channel disposed proximate the first side edge and a drain aperture disposed proximate the second side edge, wherein the drain channel of a first metal roofing panel of the plurality of roofing panels is adapted to align with the drain aperture of a laterally adjacent metal roofing panel of the plurality of metal roofing panels, an attachment clip having a leverage section including a fulcrum and a lever portion, wherein the leverage section is adapted to be attached to a roof structure substantially under the laterally adjacent metal roofing panel such that the attachment of the leverage section to the roof structure at least partially rotates the lever portion about the fulcrum, a compression section of the attachment clip, wherein the rotation of the lever portion about the fulcrum is adapted to downwardly press the compression section on an upper surface of the first metal roofing panel and an upper surface of the laterally adjacent metal roofing panel and a bridge portion of the attachment clip extending between the leverage and compression sections, wherein the bridge portion is adapted to extend above at least a portion of the drain channel of the first metal roofing panel.

In at least another aspect, a method for installing an interlocking metal roofing panel system on a roof structure, the method comprising the steps of providing a plurality of metal roofing panels, each having first and second side edges, a drain channel disposed proximate the first side edge and a drain aperture disposed proximate the second side edge, wherein the drain channel of a first metal roofing panel of the plurality of roofing panels is adapted to align with the drain aperture of a laterally adjacent metal roofing panel of the plurality of metal roofing panels, providing an attachment clip having a leverage section including a fulcrum and a lever portion, a compression section including an engagement portion and a clipping member and a bridge portion extending between the leverage and compression sections, disposing the first metal roofing panel on a roof structure, disposing the attachment clip on the roof structure and the first metal roofing panel, wherein the compression section is on an upper surface of the first metal roofing panel and the bridge portion extends above at least a portion of the drain channel of the first metal roofing panel, and wherein the leverage section is distal from the first metal roofing panel, attaching the leverage section of the attachment clip to the roof structure, wherein the attachment of the leverage section causes the lever portion to rotate about the fulcrum, and wherein the rotation of the lever causes the engagement portion to exert a downwardly compressive force on an upper surface of the first metal roofing panel, wherein the first metal roofing panel is pressed by the downwardly compressive force of the engagement portion against the roof structure and disposing the laterally adjacent metal roofing panel over at least a portion of the first metal roofing panel such that the drain aperture of the laterally adjacent metal roofing panel substantially aligns with the drain channel of the first metal roofing panel.

These and other features, advantages, and objects of the present device will be further understood and appreciated by those skilled in the art upon studying the following specification, claims, and appended drawings.

BRIEF DESCRIPTION OF THE DRAWINGS

In the drawings:

FIG. 25 is a top plan view of the modular roofing panel of FIG. 24;

FIG. 26 is a side elevational view of the modular roofing panel of FIG. 25 taken looking at a bottom edge of the modular roofing panel;

FIG. 27 is a side elevational view of the modular roofing panel of FIG. 25;

DETAILED DESCRIPTION OF EMBODIMENTS

Figure 1:
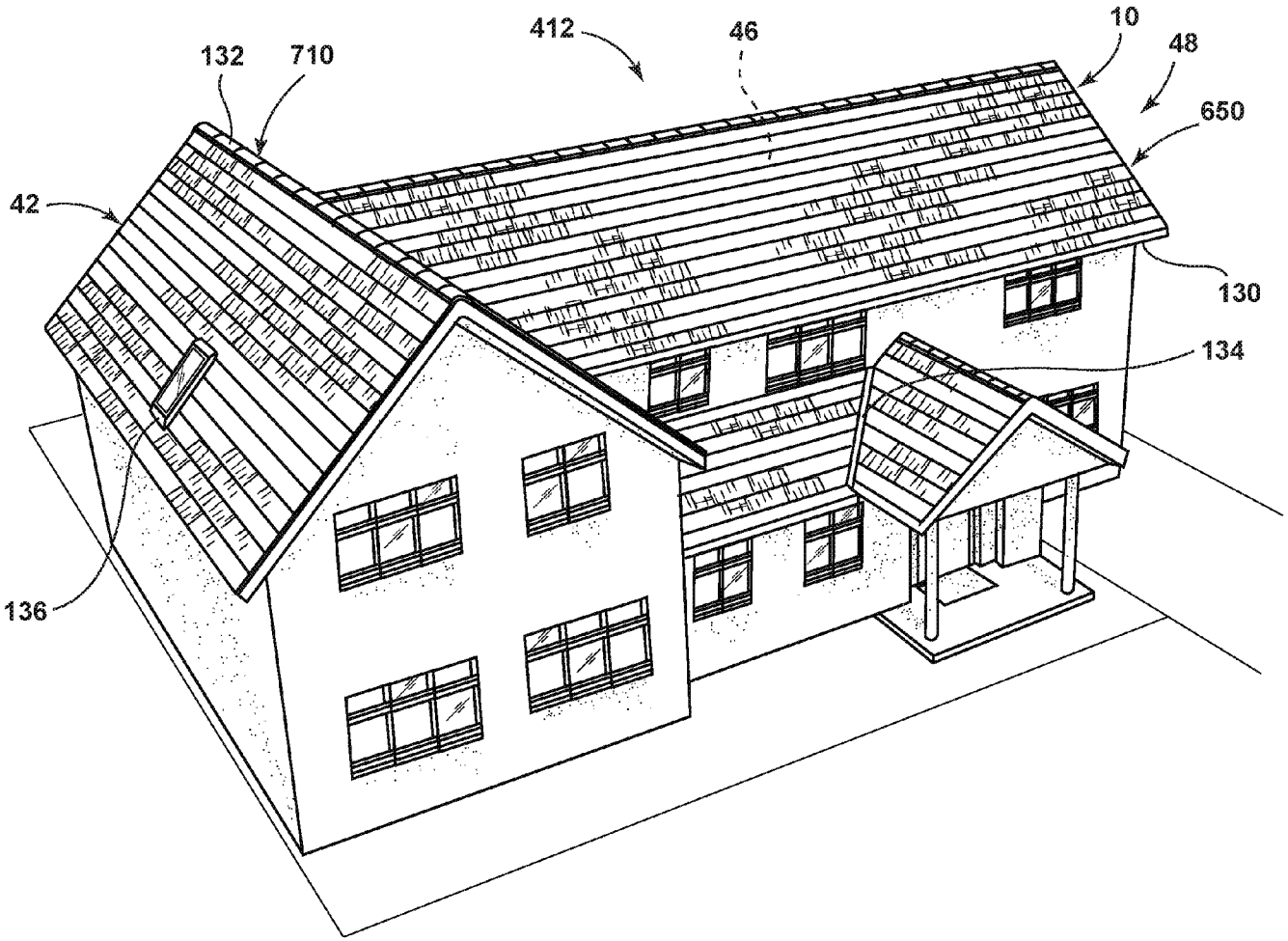
FIG. 1 is a top perspective of a residential structure incorporating an embodiment of the modular roof panel system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
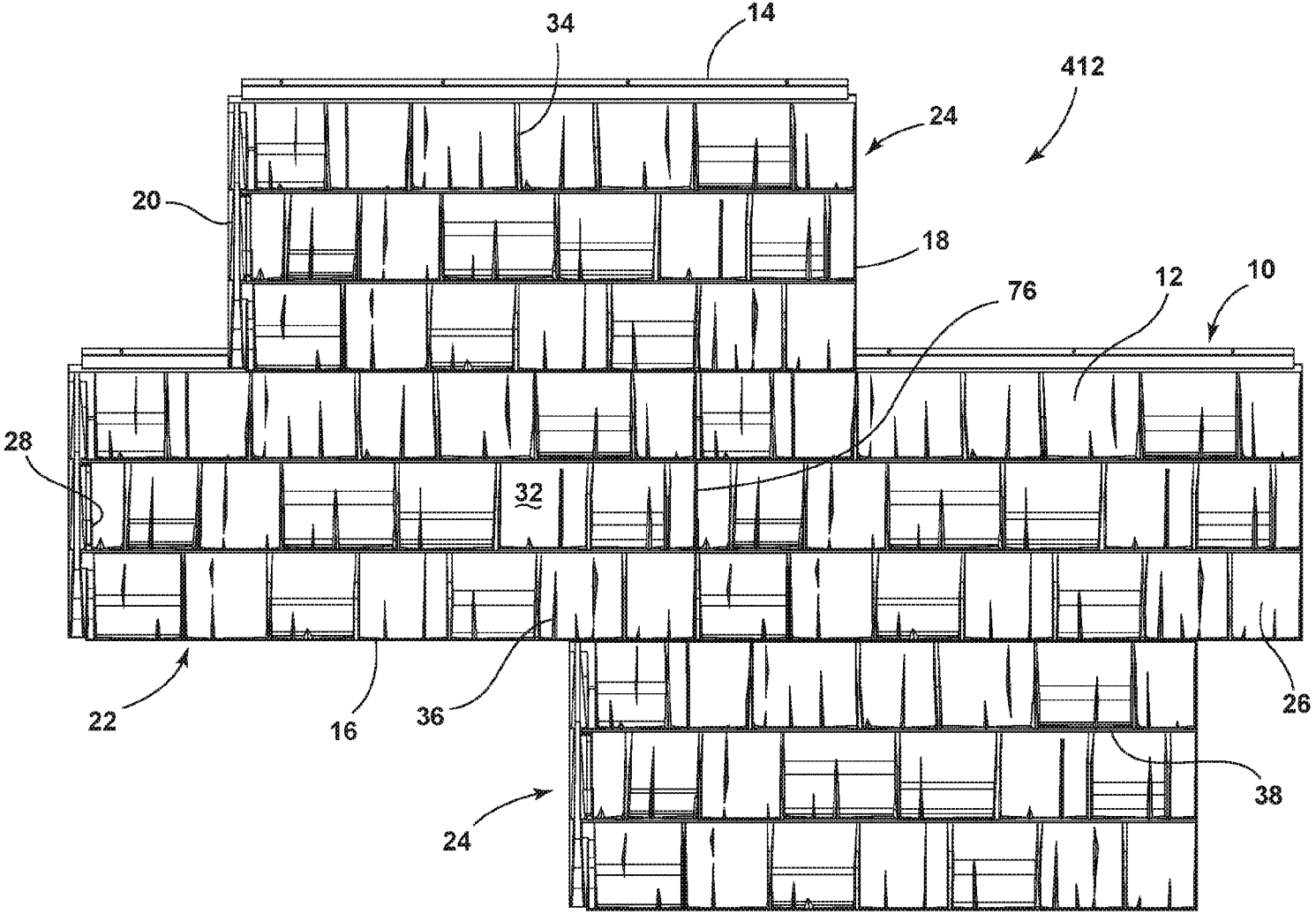
FIG. 2 is a top plan view of an embodiment of a series of modular roof panels attached in an exemplary configuration for placement upon a roof structure.
Figure 3:
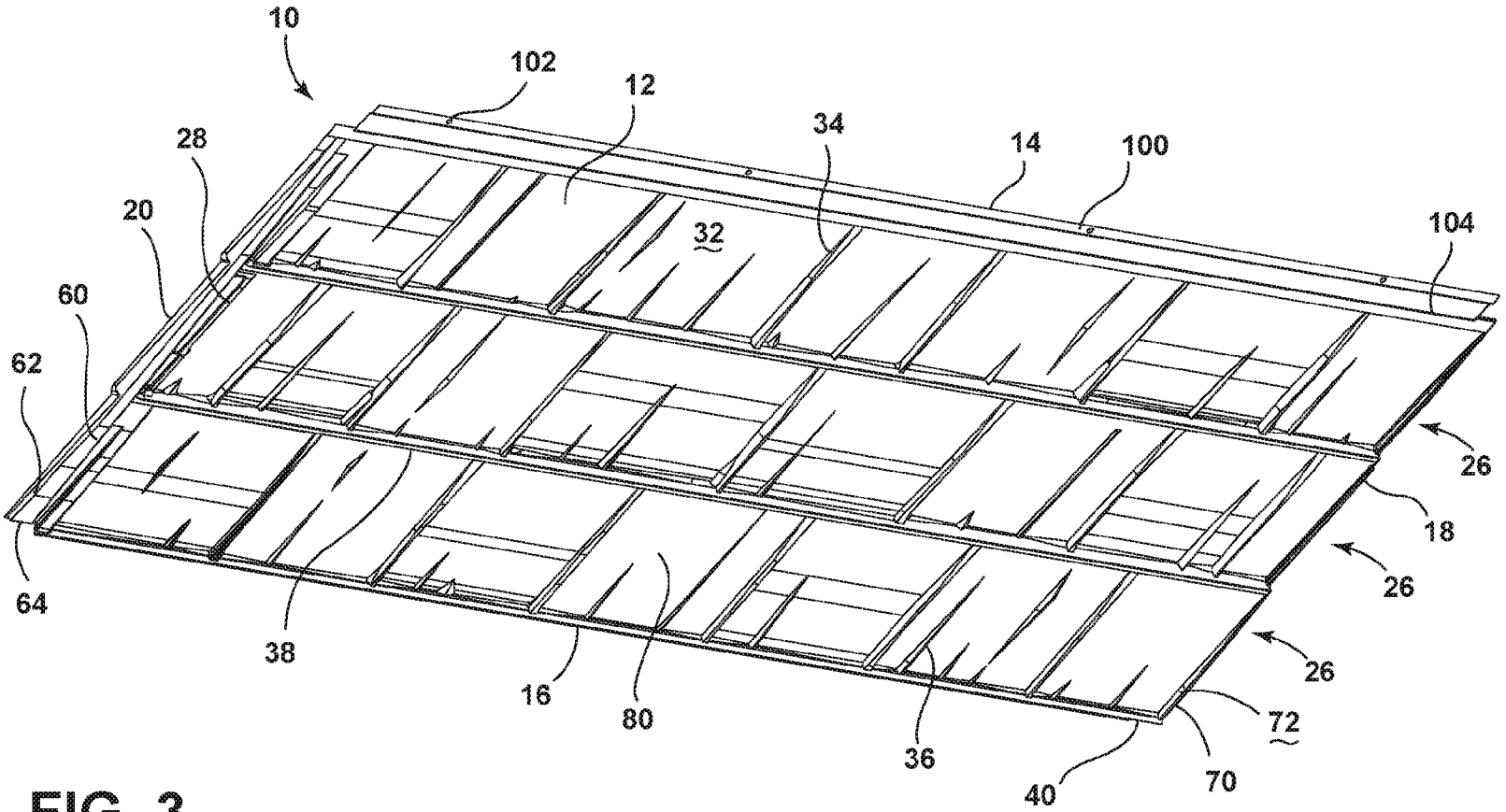
FIG. 3 is a top perspective view of an embodiment of a modular roof panel.
Figure 6:
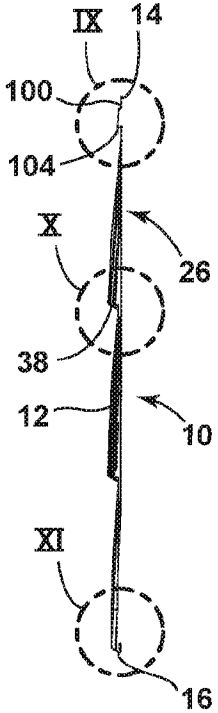
FIG. 6 is a second side elevational view of the modular roof panel of FIG. 4.
Figure 4:
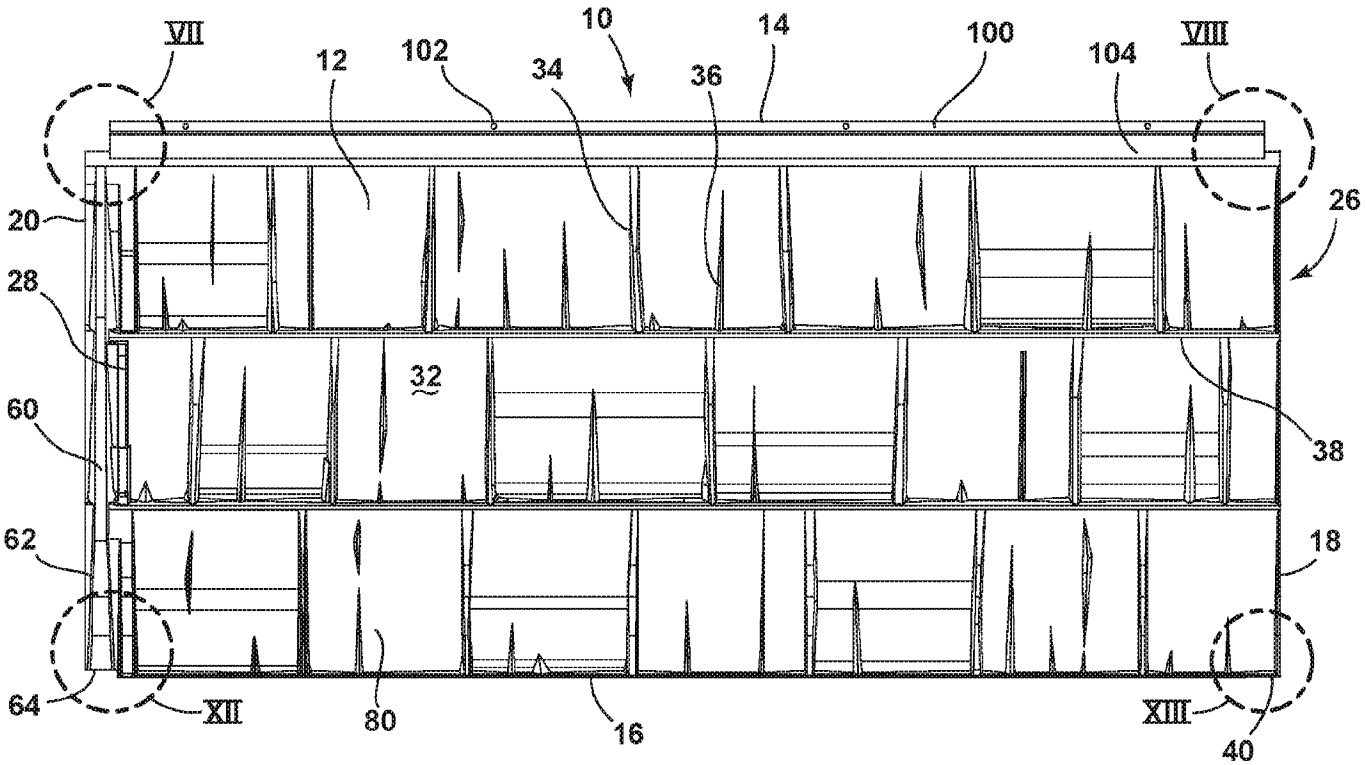
FIG. 4 is a top plan view of the modular roof panel of FIG. 3.
Figure 5:
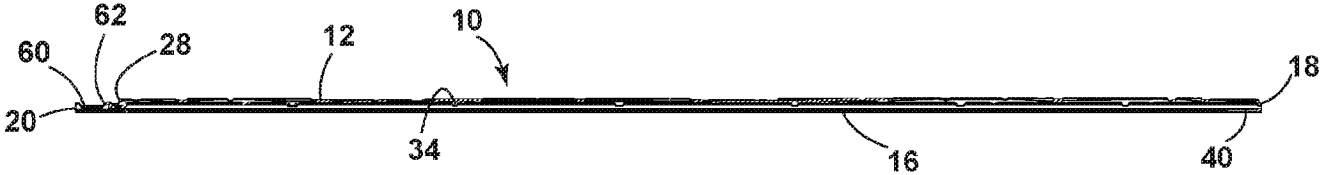
FIG. 5 is a side elevational view of the modular roof panel of FIG. 4 taken along a bottom edge of the modular roof panel.
Figure 8:
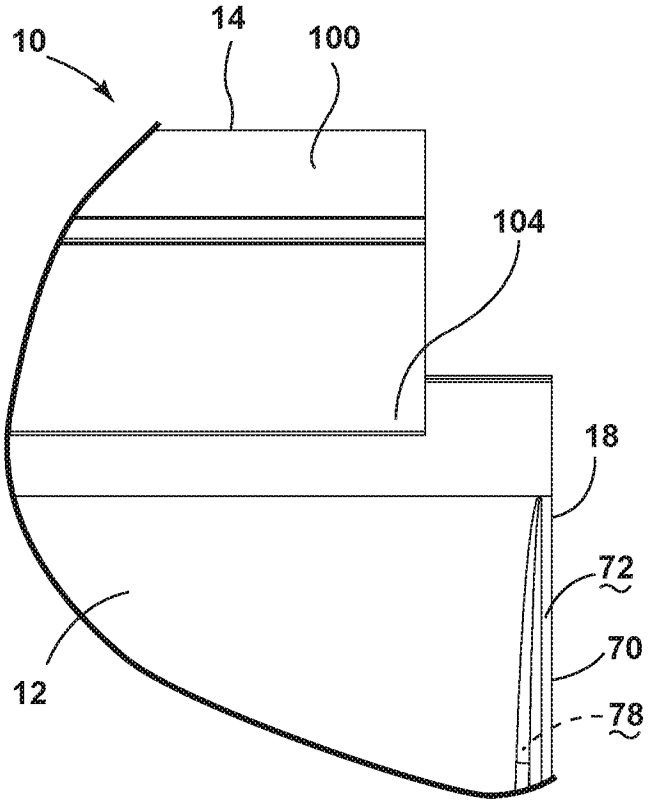
FIG. 8 is an enlarged plan view of the modular roof panel of FIG. 4 taken at area VIII.
Figure 7:
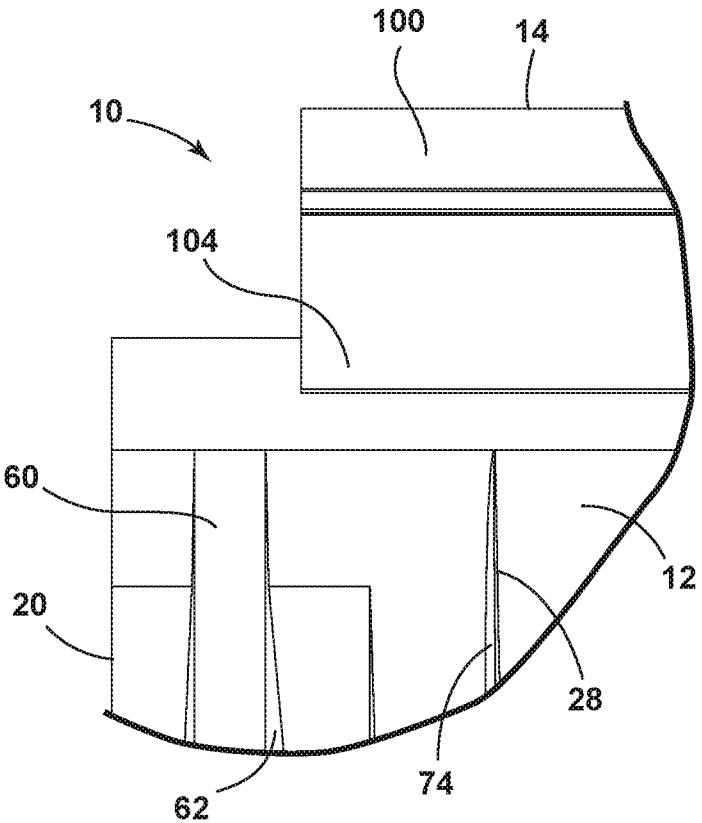
FIG. 7 is a detail plan view of the modular roof panel of FIG. 4 taken at area VII.
Figure 11:
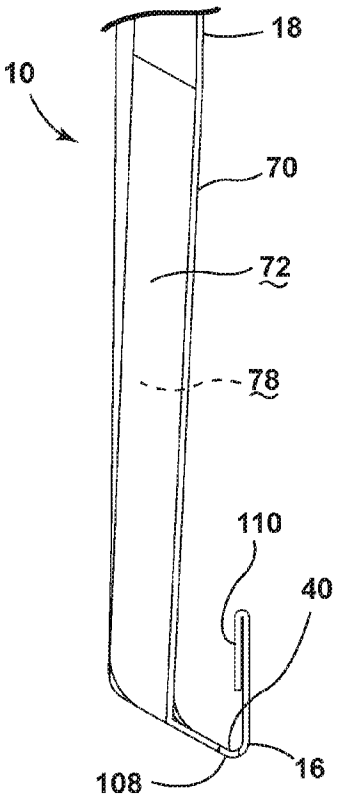
FIG. 11 is an enlarged side elevational view of the modular roof panel of FIG. 6 taken at area XI.
Figure 10:
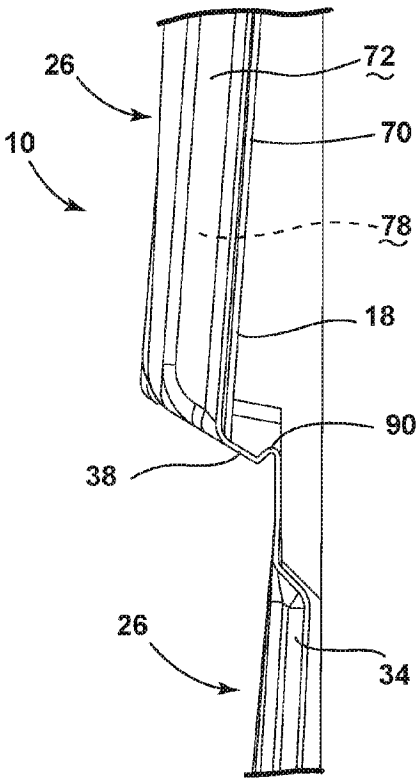
FIG. 10 is an enlarged elevational view of the modular roof panel of FIG. 6 taken at area X.
Figure 9:
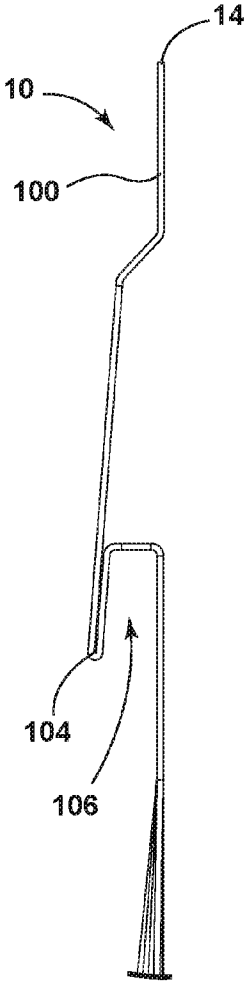
FIG. 9 is an enlarged side elevational view of the modular roof panel of FIG. 6 taken at area IX.
Figure 13:
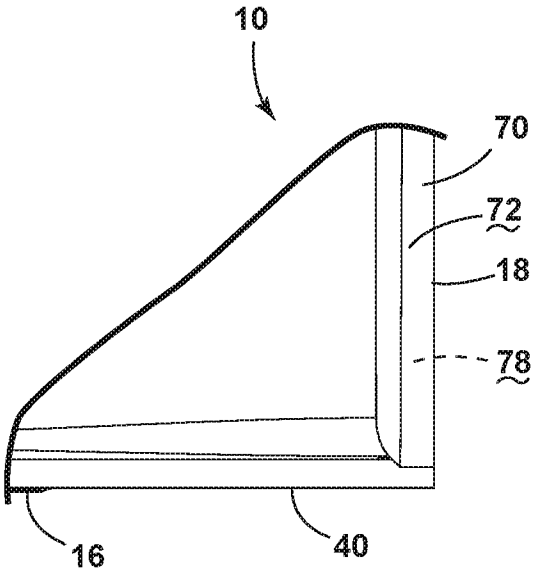
FIG. 13 is an enlarged top plan view of the modular roof panel of FIG. 4 taken at area XIII.
Figure 12:
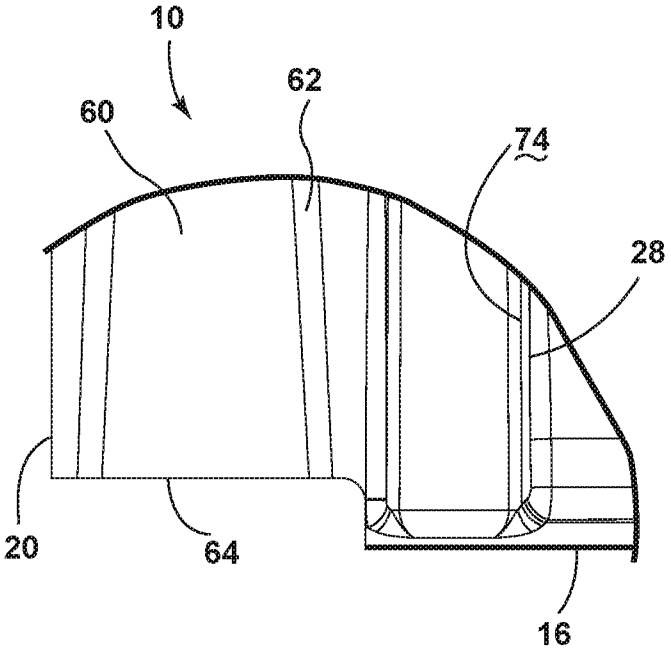
FIG. 12 is an enlarged top plan view of the modular roof panel of FIG. 4 taken at area XII.
Figure 14:
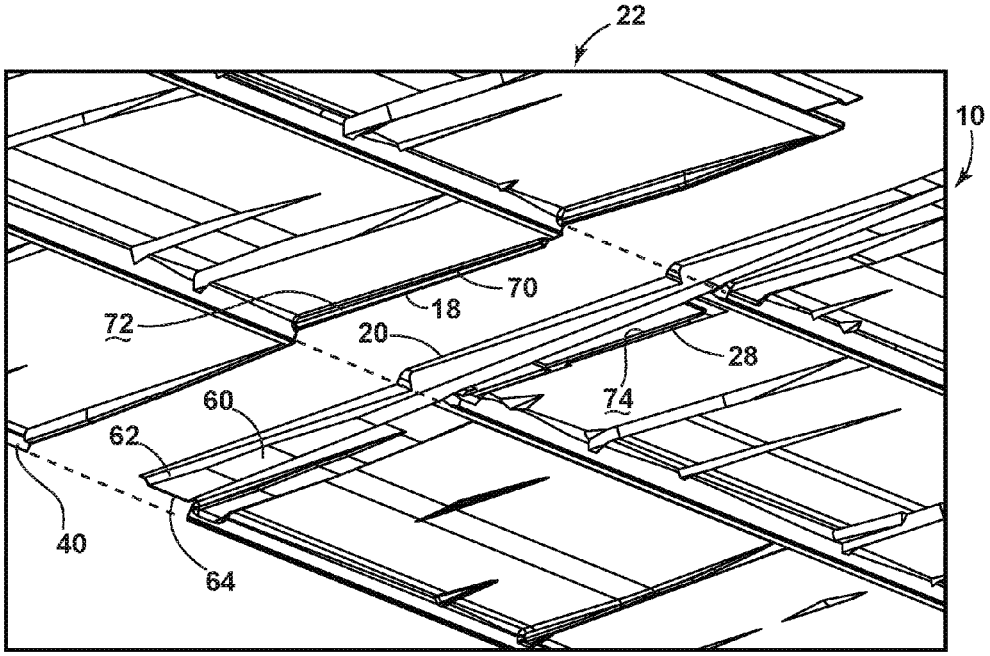
FIG. 14 is a partially exploded top perspective view of two adjacent modular roof panels.
Figure 15:
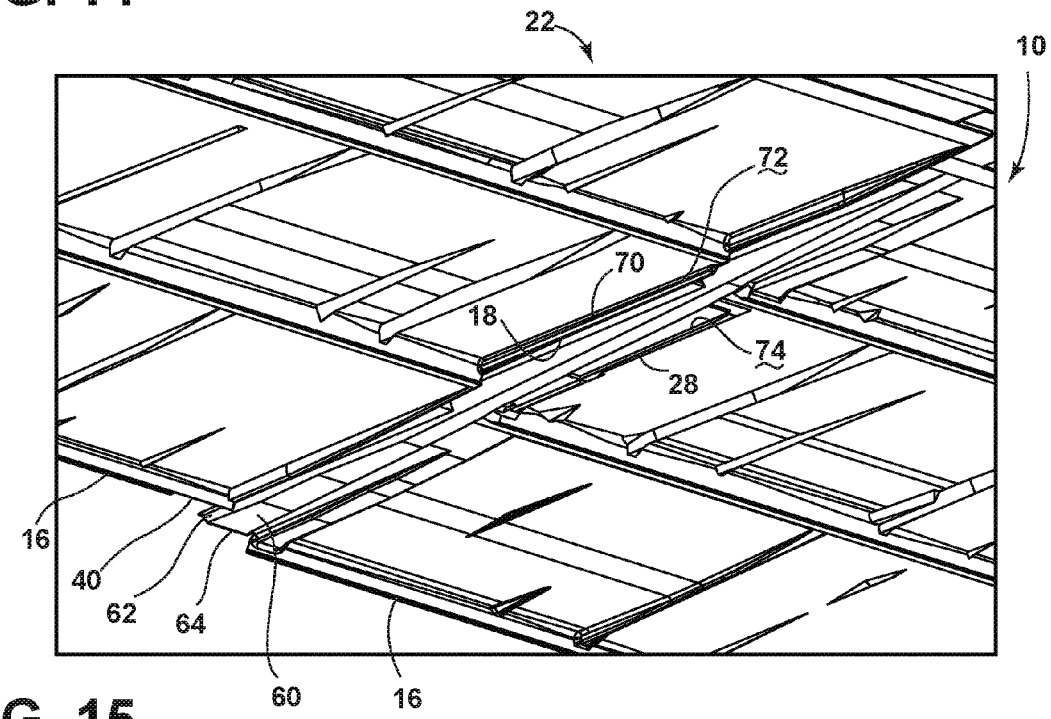
FIG. 15 is a top perspective view of the embodiment of FIG. 14 showing an adjacent modular roof panel about to be installed upon another adjacent modular roof panel.
Figure 16:
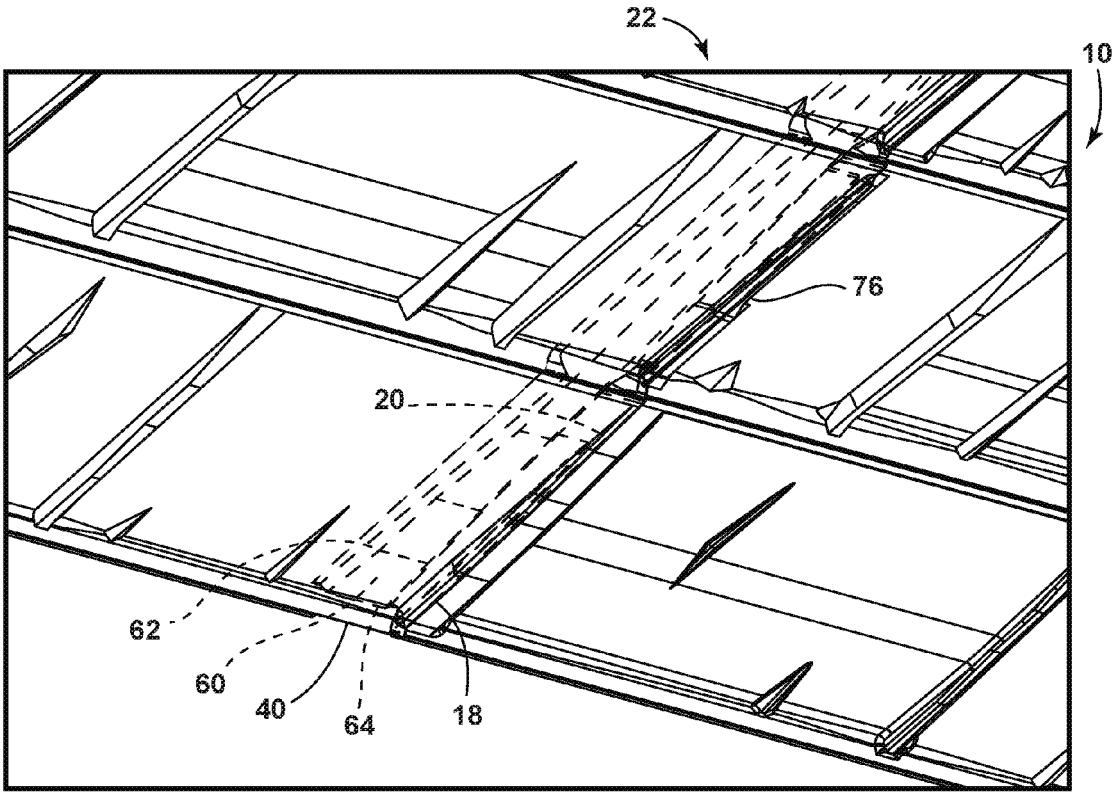
FIG. 16 is a top perspective view of two adjacent modular roof panels installed upon one another.
Figure 17:
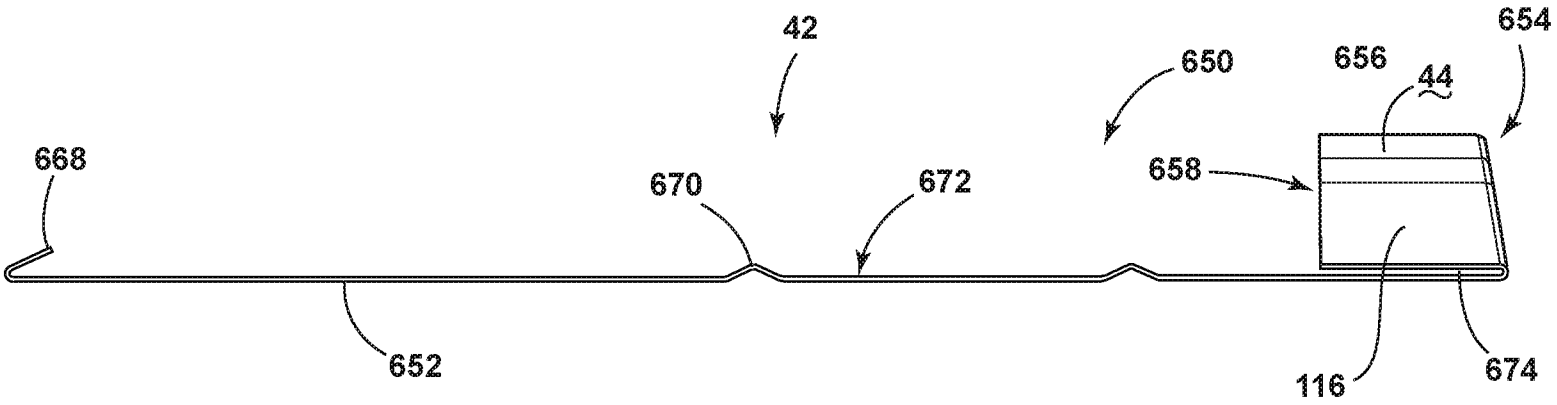
FIG. 17 is an elevational view of a gable end member of the modular roof panel system, according to one embodiment.
Figures 18, 19, 20:
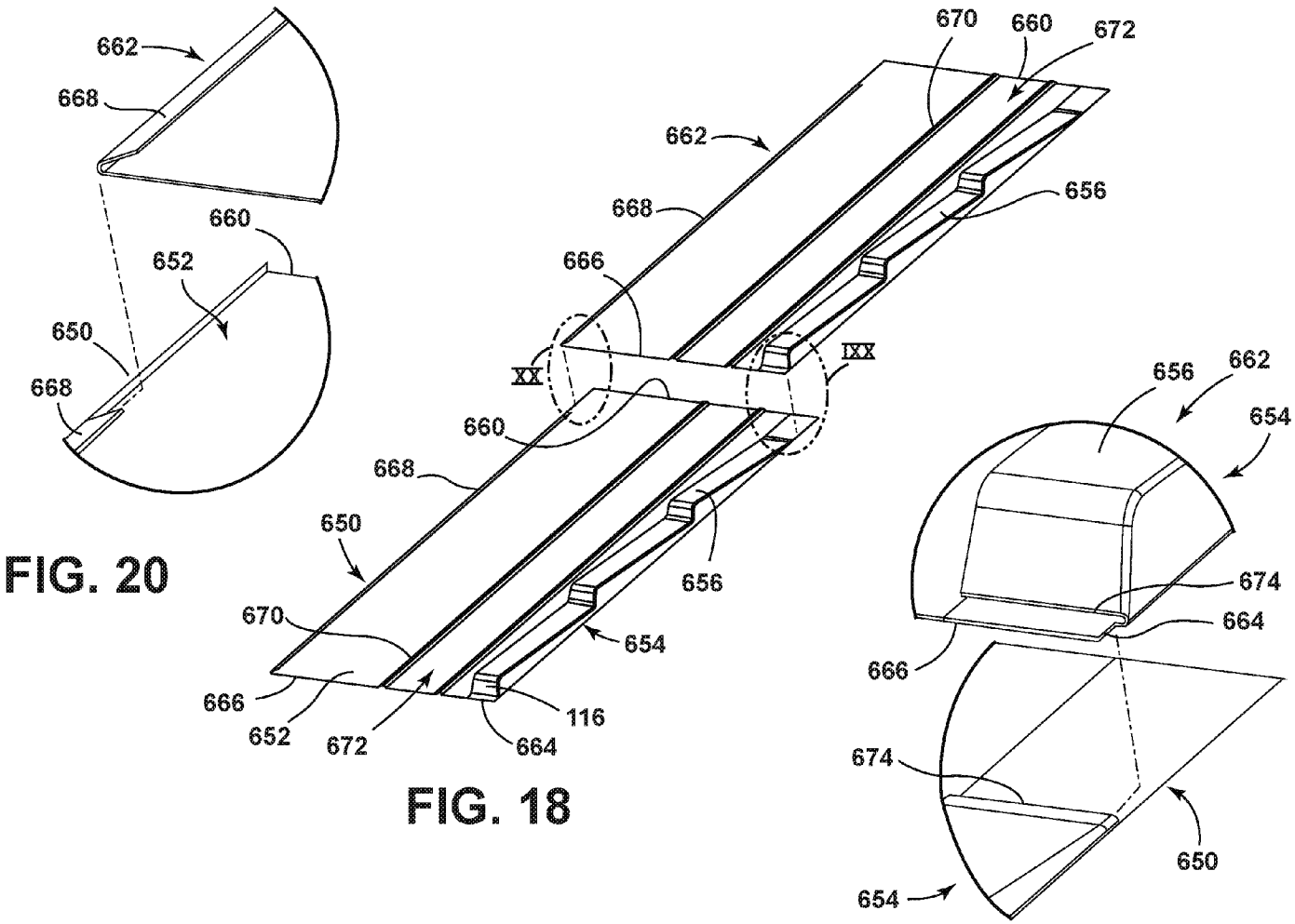
FIG. 18 is a partially exploded perspective view of two vertically adjacent gable end members about to be installed upon one another, according to one embodiment.
FIG. 19 is an enlarged perspective view of the vertically adjacent gable end members of FIG. 18 taken at area XIX.
FIG. 20 is an enlarged exploded perspective view of the vertically adjacent gable end members of FIG. 18 taken at area XX.
Figure 21:
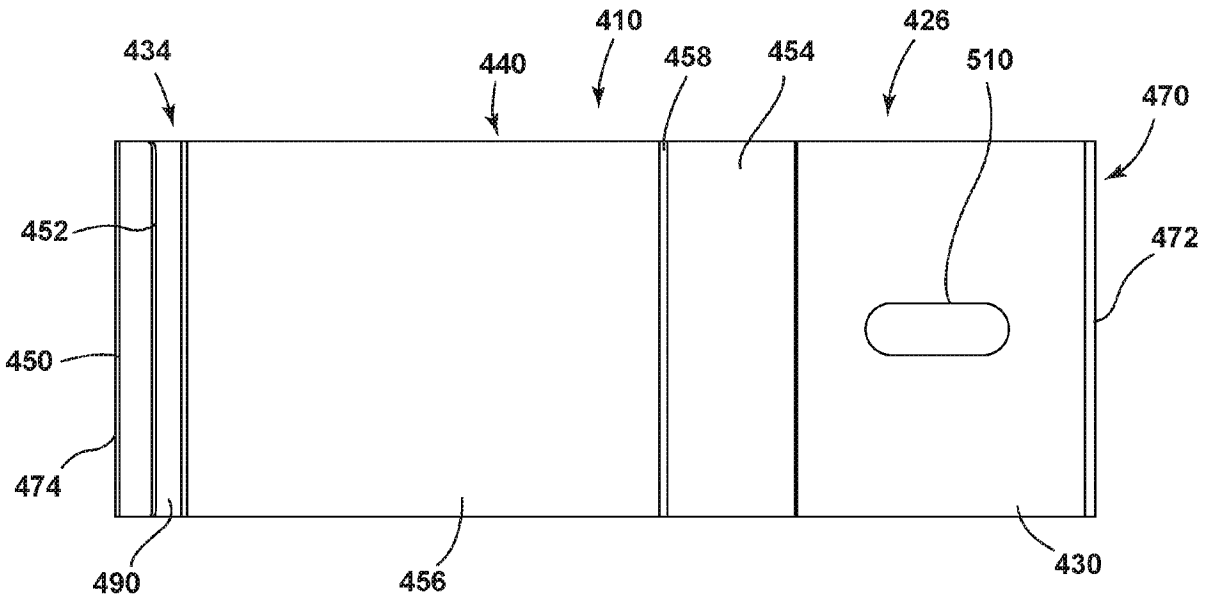
FIG. 21 is a top plan view of an attachment clip for an interlocking metal roofing panel system, according to one embodiment.
Figure 22:
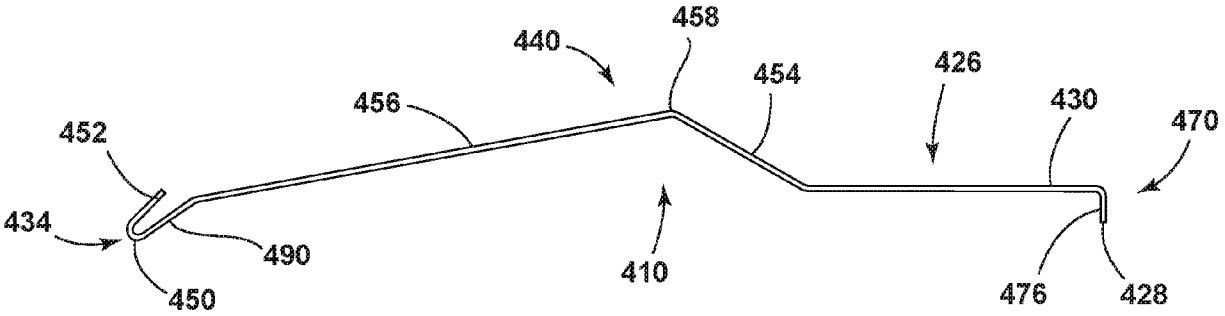
FIG. 22 is a side elevational view of the attachment clip of FIG. 21.

As shown in FIGS. 1-3, reference numeral 10 generally refers to a modular roof panel that can be disposed upon the roof structure 46 of a house 48, according to one embodiment. The modular roof panel 10 includes a generally rectangular panel, having a top connection edge 14, a bottom drip edge 16 opposite the connection edge 14, a downturn edge 18 extending generally perpendicular between the connection edge 14 and the drip edge 16, and a side channel edge 20 opposite the downturn edge 18. The downturn edge 18 of the planar body 12 is configured to overlay and engage a side channel edge 20 of a laterally adjacent modular roof panel 22. The drip edge 16 of the planar body 12 is configured to overlay and engage a connection edge 14 of at least one vertically adjacent modular roof panel 24. A plurality of courses 26 defined within the planar body 12 extend between the side channel edge 20 and the downturn edge 18. Each course 26 of the planar body 12 includes a nesting ridge 28 proximate the side channel edge 20 that is configured to receive a downturn edge 18 of a laterally adjacent modular roof panel 22 in order to position a top surface 32 of the planar body 12 so that it is substantially flush with the top surface 32 of the laterally adjacent modular roof panel 22. At least one surface channel 34 is defined within each of the plurality of courses 26. A plurality of contoured structural ridges 36 are defined at least within a lower edge 38 of each course 26. A drain aperture 40 is defined within the drip edge 16, wherein the drain aperture 40 is configured to align with a side channel edge 20 of a laterally adjacent modular roof panel 22. In this manner, fluid, particulate material and other debris that are disposed within the side channel edge 20 of the laterally adjacent modular roof panel 22 is directed through the drain aperture 40 of the drip edge 16 and onto a top surface 32 of a vertically adjacent modular roof panel 24. A gable end member 42 is configured to engage at least one of the downturn edge 18 and the side channel edge 20 of the planar body 12, where the planar body 12 has one or fewer laterally adjacent modular roof panels 22 engaged thereto. An upper surface 44 of the gable end member 42 is configured to be substantially flush with the top surface 32 of the planar body 12.

Referring now to the embodiment illustrated in FIGS. 2-16, the channel edge 20 includes a drain channel 60 that extends substantially along the entire length of the side channel edge 20. In this manner, the drain channel 60 is configured to collect rainwater and other fluid that may seep or become disposed between two adjacent modular roof panels 10. The collected fluid and debris can be funneled down the drain channel 60 and through an aligned drain aperture 40 of a laterally adjacent modular roof panel 22 so that the collected fluid can be directed upon and down the top surface 32 of the vertically adjacent modular roof panels 24. In this manner, when the modular roof panels 10 are installed upon a roof structure 46, rainwater, other fluid and debris that falls upon the modular roof panels 10 is substantially prevented from reaching the roof structure 46 beneath the modular roof panels 10. The sidewalls 62 of the drain channel 60 are configured to have a profile substantially similar to that of the courses 26 defined within the planar body 12 of the modular roof panel 10. Accordingly, certain areas of the drain channel 60 may have a higher sidewall 62 than other portions of the drain channel 60 to follow the generally stepping configuration of the courses 26. In the various embodiments, the drain channel 60 is configured to direct fluid and debris toward a bottom drain edge 64. When the modular roof panels 10 are installed upon a roof structure 46, the bottom drain edge 64 of one of the modular roof panels 10 is configured to extend over the connection edge 14 of a vertically adjacent modular roof panel 24 that is installed below the bottom drain edge 64. Additionally, the bottom drain edge 64 of the modular roof panel 10 rests upon the top surface 32 of the vertically adjacent modular roof panel 24 such that water disposed within the drain channel 60 is directed toward and upon the top surface 32 of the vertically adjacent modular roof panel 24.

Referring again to the embodiments illustrated in FIGS. 2-16, the downturn edge 18 of the modular roof panel 10 includes a downward flange 70. The downward flange 70 of the downturn edge 18 extends substantially the length of the downturn edge 18, such that each of the courses 26 in the lower edge 38 of each course 26 includes a portion of the downward flange 70. The downward flange 70 is configured to engage a laterally adjacent modular roof panel 22 at the nesting ridge 28 that is defined within a portion of the side channel edge 20. An outer surface 72 of the downward flange 70 is configured to engage a receiving face 74 of the nesting ridge 28. In this manner, the seam 76 between two modular roof panels 10 can be minimized as a result of the nesting engagement between the downward flange 70 and the nesting ridge 28. In various embodiments, portions of the nesting ridge 28 can be configured to engage an inner surface 78 of the downward flange 70. Such a connection is typically found where the planar body 12 includes a side channel edge 20 that abuts a surface channel 34 of one of the courses 26. In this manner, the outer surface 72 of the downward flange 70, when installed against the laterally adjacent modular roof panel 22, will define a portion of the surface channel 34. In conditions where the outer surface 72 of the downward flange 70 engages the surface of the receiving face 74 of the nesting ridge 28 of the laterally adjacent modular roof panel 22, the surface channel 34 of that particular course 26 is generally distal from the side channel edge 20 and the downturn edge 18, but, rather is defined within an interior portion 80 of the course 26.

In the various embodiments, the downward flange 70 of the downturn edge 18 provides added structure to the downturn edge 18, while at the same time providing a substantially hidden overlap and a minimal seam 76 between modular roof panels 10. Additionally, the downturn edge 18 of the modular roof panel 10 substantially follows the generally stepped contour of the various courses 26 defined within the planar body 12 of the modular roof panel 10.

Referring now to the embodiments illustrated in FIGS. 2-16, each of the courses 26 defined within the planar body 12 of the modular roof panel 10 includes the lower edge 38 that extends downward from one course 26 to an adjacent course 26 defined within the planar body 12. In this manner, the top surface 32, the lower edge 38, and the various surface channels 34 within each course 26 define a tile-type pattern along the length of each course 26. The patterns can include a shake pattern, a slate tile pattern (shown in FIGS. 23-25), and various other tile and/or natural roofing material patterns within the planar body 12 of the modular roof panel 10. The lower edge 38 of each course 26 provides a downward transition from a course 26 disposed proximate the connection edge 14 toward the lower courses 26 defined within the planar body 12 and which are disposed closer to the drip edge 16 of the planar body 12.

Referring again to the embodiment of FIGS. 2-16, the various surface channels 34 that are disposed within each of the courses 26 of the planar body 12 can be disposed in various patterns among the courses 26. One such pattern can include an alternating configuration where a surface channel 34 within one course 26 lies substantially between two surface channels 34 defined within an adjacent course 26. In various alternate embodiments, the various surface channels 34 can be substantially aligned. Alternative configurations can include irregular patterns of surface channels 34 that are configured to aesthetically reflect differing sizes of shakes or tiles within each course 26. The individual surface channels 34 can also have varying widths and profiles to reflect the irregular nature of naturally cut roofing materials. The various surface channels 34 can also include substantially uniform profiles and thicknesses to reflect more precise and machined-type aesthetics.

Referring again to the embodiment illustrated in FIGS. 2-16, the lower edge 38 of each course 26, as well as the top surface 32 and surface channels 34 of each course 26, can include contoured structural ridges 36 that provide added structure to the interior portions 80 of the planar body 12. The contoured structural ridges 36 also provide aesthetic detail to allow each of the courses 26 to more closely resemble the particular roofing pattern intended to be defined within the planar body 12 of the modular roof panel 10, as described above. In the various embodiments, the lower edge 38 of each of the courses 26 can include an undercut feature 90, wherein a portion of the lower edge 38 is rolled under the course 26 and then rolled back toward the next course 26 in an "S" type configuration (shown in FIG. 10). The undercut feature 90 of the lower edge 38 is configured to add structural integrity to the interior portions 80 of the planar body 12 of the modular roof panel 10. Additionally, the undercut feature 90 also provides aesthetic features to replicate the overlapping of one course 26 upon another.

In the various embodiments, the contoured structural ridges 36 that are defined within the lower edge 38 and top surface 32 of each course 26 and also within the surface channels 34 of each course 26 can also be configured into irregular patterns to reflect a more natural aesthetic. The various contoured structural ridges 36 can be configured to be locally disposed proximate the surface channels 34 and the lower edge 38 of each course 26, and can also be disposed within the top surface 32 of each course 26 distal from the various surface channels 34.

The various contoured structural ridges 36 defined within the planar body 12 of the modular roof panel 10 can be configured to be identical among the various modular roof panels 10 installed upon the roof structure. In various alternate embodiments, the plurality of differing contoured structural ridges 36 can be defined within various modular roof panels 10, wherein two or more differing patterns of contoured structural ridges 36 can be defined within the various modular roof panels 10 installed upon the roofing structure.

Referring again to the embodiment illustrated in FIGS. 2-16, the connection edge 14 can include a connection flange 100 that defines a plurality of guide holes 102 that are configured to receive fasteners. The various fasteners that can be inserted through the guide holes 102 and into the roof structure 46 can include, but are not limited to, nails, screws, and other similar fasteners. The connection flange 100 can include a folded portion 104 that defines a receiving channel 106 configured to receive a bottom flange 108 of the drip edge 16. The bottom flange 108 is curved back toward the connection edge 14 such that it can be positioned within the receiving channel 106. The bottom flange 108 can further include an end fold 110 that provides a thickened portion of the bottom flange 108 that can be securely fit within the receiving channel 106. The thickness of the end fold 110 of the bottom flange 108 is substantially the same thickness as the receiving channel 106. In this manner, the engagement of the end fold 110 with the receiving channel 106 can provide an at least partial interference connection.

Referring now to the embodiment illustrated in FIGS. 2 and 14-16, when the various modular roof panels 10 are installed upon a roof structure, the modular roof panels 10 are aligned such that the downturn edge 18 of one modular roof panel 10 overlaps the side channel edge 20 of the laterally adjacent modular roof panel 22. In this manner, the downward flange 70 of one modular roof panel 10 engages the nesting ridge 28 of the laterally adjacent modular roof panel 22. This engagement creates a minimal seam 76 between the modular roof panels 10. This engagement also properly aligns the drain aperture 40 defined within the drip edge 16 of one modular roof panel 10 to be in line with the drain channel 60 defined within the side channel edge 20 of the laterally adjacent modular roof panel 22. As discussed above, the alignment of the drain channel 60 and the drain aperture 40 allows substantially all of the fluid that may seep under one of the modular roof panels 10 to be funneled away from the underside of the modular roof panel 10 onto the top surface 32 of the vertically adjacent modular roof panel 24 and down the top surface 32 of the modular roof panels 10. The minimal seam 76 created by the engagement of the downward flange 70 and the nesting ridge 28 is configured to substantially conceal the connection points between adjacent modular roof panels 10 to provide a more natural look that mimics the look of natural slate tile, shakes, or other similar tile roofing material. The minimal seam 76 is further camouflaged by the appearance of various contoured structural ridges 36 that extend through the top surface 32 of the various courses 26 defined within the planar body 12 of the modular roof panel 10. With the seams 76 between the modular roof panels 10 being hidden and camouflaged, the installed modular roof panels 10 take on the look of the natural roofing material that the modular roof panels 10 are designed to recreate.

Referring now to the embodiment illustrated in FIGS. 2-16, the connection flange 100 disposed proximate the connection edge 14 of the modular roof panel 10 can include a plurality of curved, folded or rolled features to provide structural integrity to the connection flange 100 and to also provide a connection point into which the drip edge 16 of a vertically adjacent modular roof panel 24 can be attached. The drip edge 16 of the modular roof panel 10 includes the bottom flange 108 that is rolled back under the drip edge 16 and is configured to extend a predetermined distance back toward the connection edge 14 of the modular roof panel 10. In this manner, the bottom flange 108 of the drip edge 16 is configured to extend under at least a portion of the connection flange 100 and within the receiving channel 106 of the vertically adjacent modular roof panel 24. This engagement provides a substantially secure connection between the modular roof panel 10 and the vertically adjacent modular roof panel 24 and also provides an aesthetic appearance that is substantially similar to the undercut feature 90 defined within the lower edge 38 of the various courses 26 defined within the planar body 12. It is further contemplated that the drain aperture 40 of the drip edge 16 can be defined within the bottom flange 108 of the drip edge 16. It is further contemplated that the locations of the guide holes 102 of the modular roof panels 10 are positioned along the connection edge 14 to allow the modular roof panels 10 to be installed in a staggered configuration substantially similar to a running-bond-type pattern, wherein the downturn and side channel edges 18, 20, as well as the drain aperture and channel 40, 60 of the modular roof panel 10 align with areas between the downturn and side channel edges 18, 20 of the vertically adjacent modular roof panels 24. This configuration substantially ensures that drainage from the drain apertures 40 runs down the top surface 32 of the course 26 of the various modular roof panels 10. Additionally, the positioning of the guide holes 102 also guides the installation of the modular roof panels 10. In this manner, the material patterns defined within the planar body 12, including the courses 26, surface channels 34, contoured structural ridges 36, textures and other features form a continuous pattern over the entire roof structure with the seams 76 between the modular roof panels 10 being minimally visible, if at all.

In the various embodiments, the planar body 12 of the modular roof panel 10 can include various textures that are configured to mimic a predetermined material that is intended to be defined within the modular roof panel 10. The various textures can include slate, wood, thatch and other various natural roofing materials. The texture that is defined within the planar body 12 is intended to convey the details of the predetermined material, without providing cavities or depressions within which substantial amounts of fluid and other material can collect.

Referring now to the embodiment illustrated in FIGS. 1-6 and 17-20, when the modular roof panels 10 are installed upon the roof structure, various modular roof panels 10 will be disposed along the edge of the roof structure proximate a gable. In these end conditions proximate the gable, a gable end member 42 can be attached to either the downturn edge 18, the side channel edge 20, or some other edge defined within the planar body 12 where the modular roof panel 10 has been cut to accommodate the exact dimensions of the roof structure. The gable end member 42 is configured to extend under the modular roof panel 10 and, in various embodiments, extend over the modular roof panel 10 to provide a finished edge condition for each modular roof panel 10 that is disposed proximate the gable. The upper surface 44 of the gable end member 42 includes a stepped profile that corresponds to the generally stepped configuration of the various courses 26 of the planar body 12. In the various embodiments, where the gable end member 42 is being disposed over the side channel edge 20, the gable end member 42 can include a drain aperture 40 at the bottom edge 116 of the gable end member 42 such that water that is disposed within an adjacent drain channel 60 can be funneled away from the side channel edge 20 and down the top surface 32 of each of the modular roof panels 10. Also, where the gable end member 42 is being disposed over the downturn edge 18, the gable end member 42 can include a drain channel 60 that cooperates with the drain aperture 40 disposed proximate the downturn edge 18. Additional details regarding the embodiments of the gable end member 42 will be discussed more fully below.

In various embodiments, transition members can be disposed on a portion of the modular roof panel 10 at the downturn edge 18, the side channel edge 20, or some alternate precut edge, wherein one of these edges is disposed proximate a roof transition, such as an eave 130, trough, ridge 132, hip, dormer, valley 134, vent, flashing, skylight 136 or other similar roof transition that may be installed within a roof structure. It is contemplated that the connections between the various modular roof panels 10 and between the modular roof panels 10 and the various transitions and gable end members 42 are substantially hidden from view such that the seams 76 between the various panels, ends and transitions are not readily apparent. In this manner, the modular roof panels 10, when installed on a roof structure, along with the various gable end members 42 and transition members, take on the appearance of a natural roofing material, such as slate, shakes, and others. Embodiments of various roof transition members will be discussed in greater detail below.

In the various embodiments, the modular roof panels 10 are typically installed on a roof structure 46 with some form of underlayment or barrier disposed between the modular roof panels 10 and the roof structure. This underlayment can include various materials that include, but are not limited to, tar paper, bituminous material, waterproofing, insulation, felt layers, among others. In various embodiments, the modular roof panels 10 can be adhered to the underlayment, or attached thereto, or a combination thereof. Additionally, various backing materials can be disposed on the modular roof panel 10 prior to installation. Such backing materials can serve to add certain strength and structural reinforcement, as well as insulating qualities to various portions of the modular roof panel 10. The various backing materials used in various embodiments can include foam, rubberized materials, rigid insulation, and others. These various backing materials can be fastened, adhered, sprayed on, or otherwise attached to the back surface of the modular roof panel 10, depending on the backing material used and the conditions within which the modular roof panel 10 is to be installed.

Figure 23:
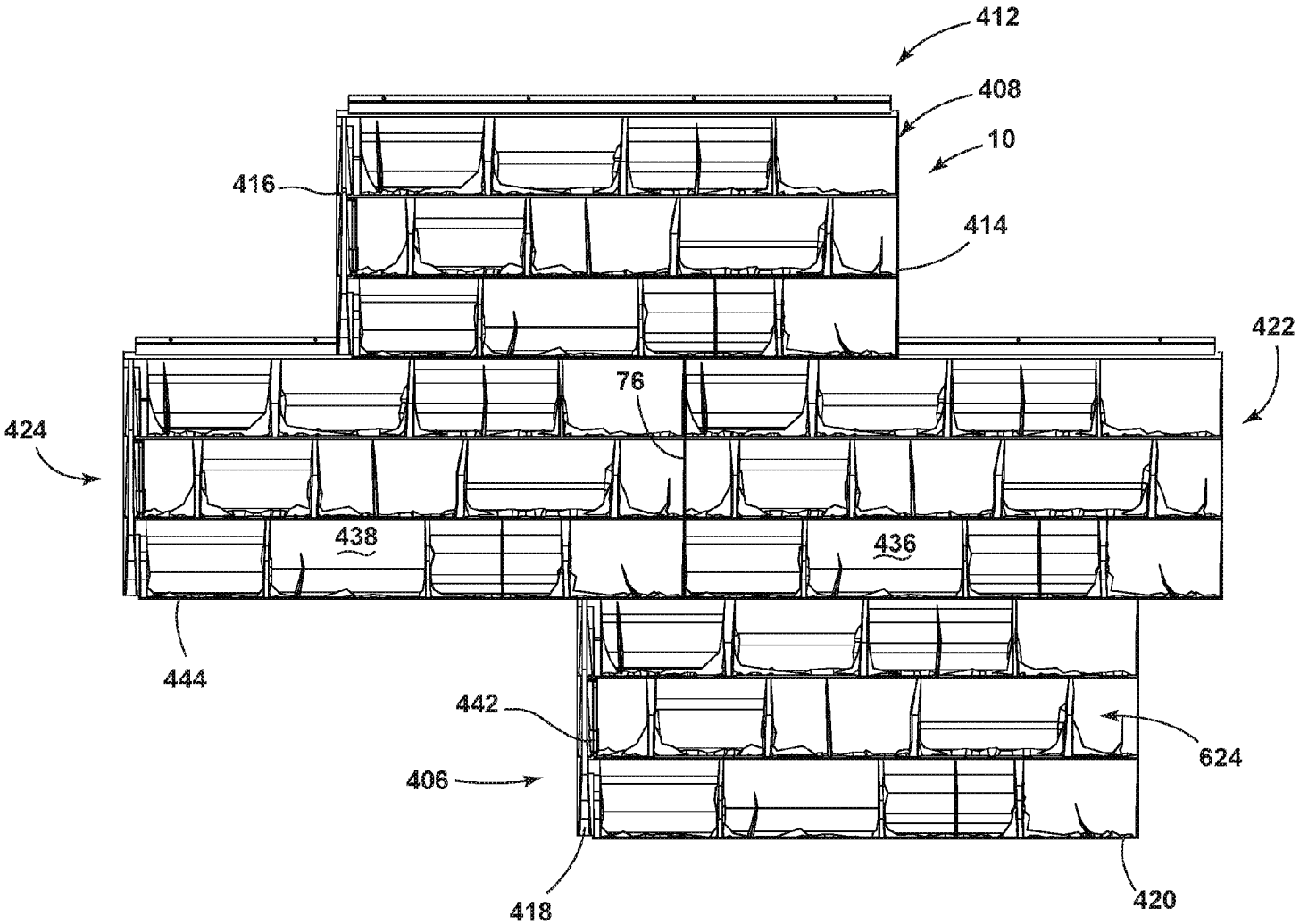
FIG. 23 is a top plan view of several modular roofing panels of the interlocking metal roofing panel system, shown connected together in exemplary configuration for attachment to a roof structure.
Figure 24:
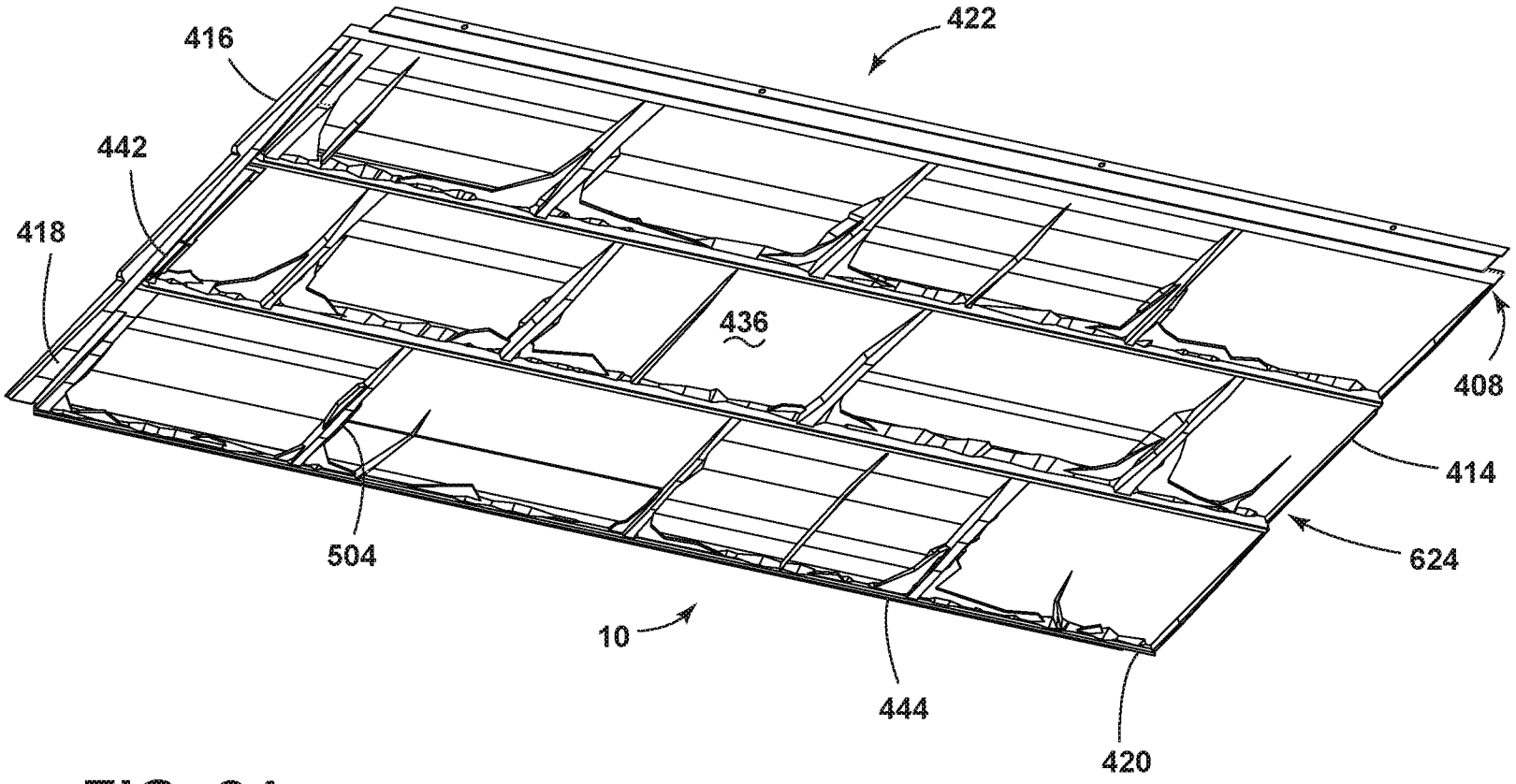
FIG. 24 is a top perspective view of an embodiment of the modular roofing panel.
Figure 29:
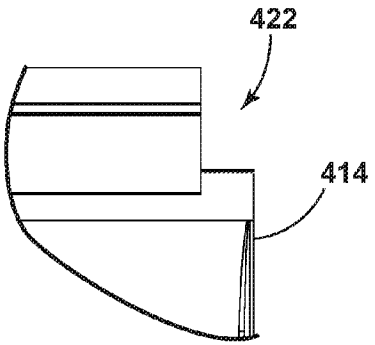
FIG. 29 is an enlarged top plan view of the modular roofing panel of FIG. 25 taken at area XXIX.
Figure 31:
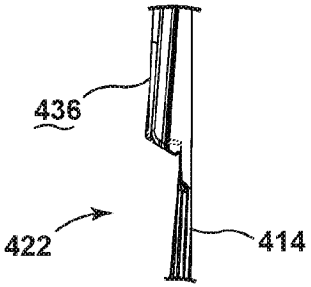
FIG. 31 is an enlarged side elevational view of the modular roofing panel of FIG. 28, taken at area XXXI.
Figure 28:
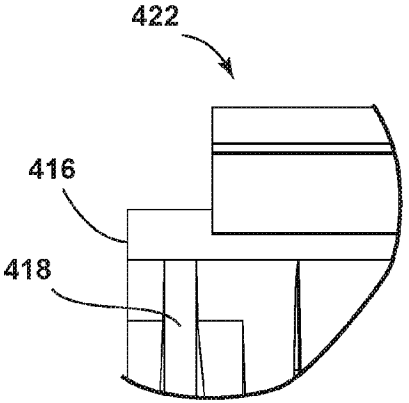
FIG. 28 is an enlarged top plan view of the modular roofing panel of FIG. 25 taken at area XXVIII.
Figure 30:
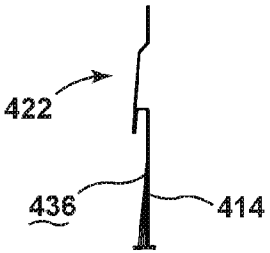
FIG. 30 is an enlarged side elevational view of the metal roofing panel of FIG. 26, taken at area XXX.
Figure 33:
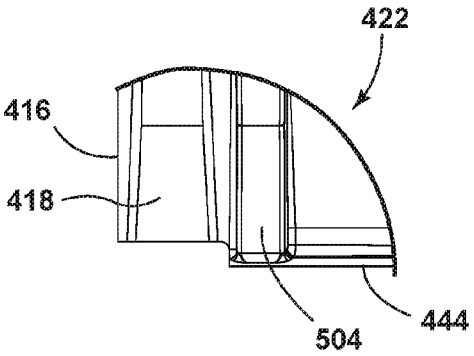
FIG. 33 is an enlarged top plan view of the modular roofing panel of FIG. 25, taken at area XXXIII.
Figure 35:
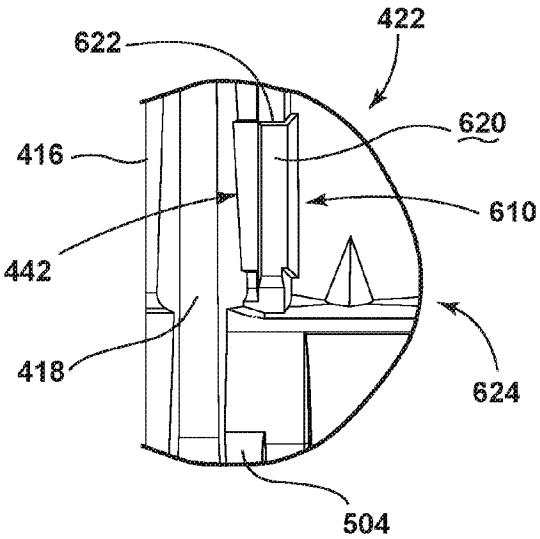
FIG. 35 is an enlarged top plan view of the modular roofing panel of FIG. 25, taken at area XXXV.
Figure 32:
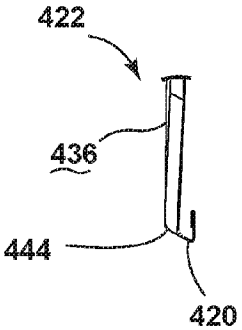
FIG. 32 is an enlarged side elevational view of the modular roofing panel of FIG. 26 taken at area XXXII.
Figure 34:
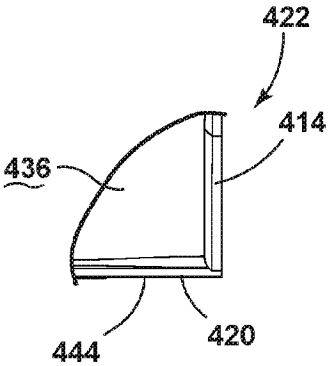
FIG. 34 is an enlarged top plan view of the modular roofing panel of FIG. 25, taken at area XXXIV.
Figure 36:
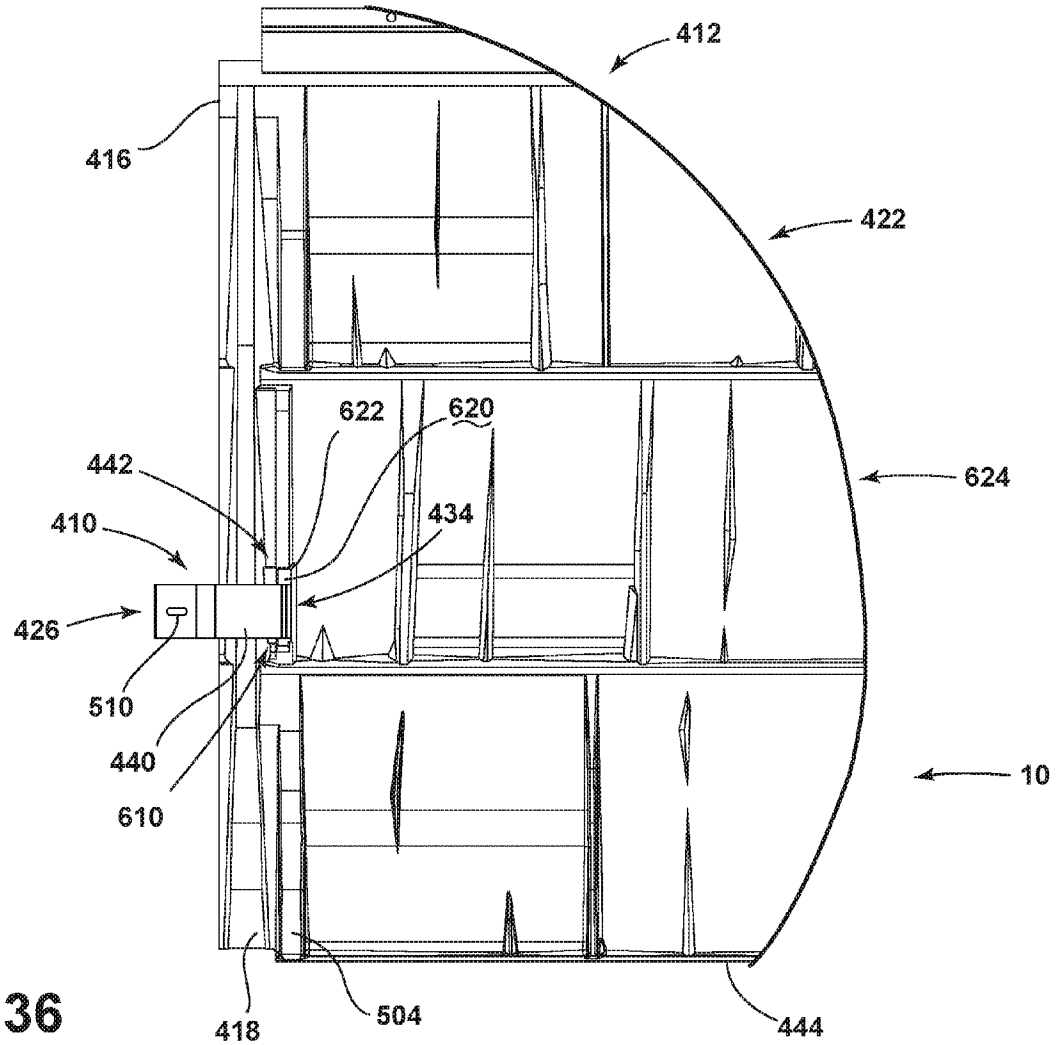
FIG. 36 is an enlarged top plan view of the modular roofing panel of FIG. 25, shown with an embodiment of the attachment clip installed thereon.
Figure 37:
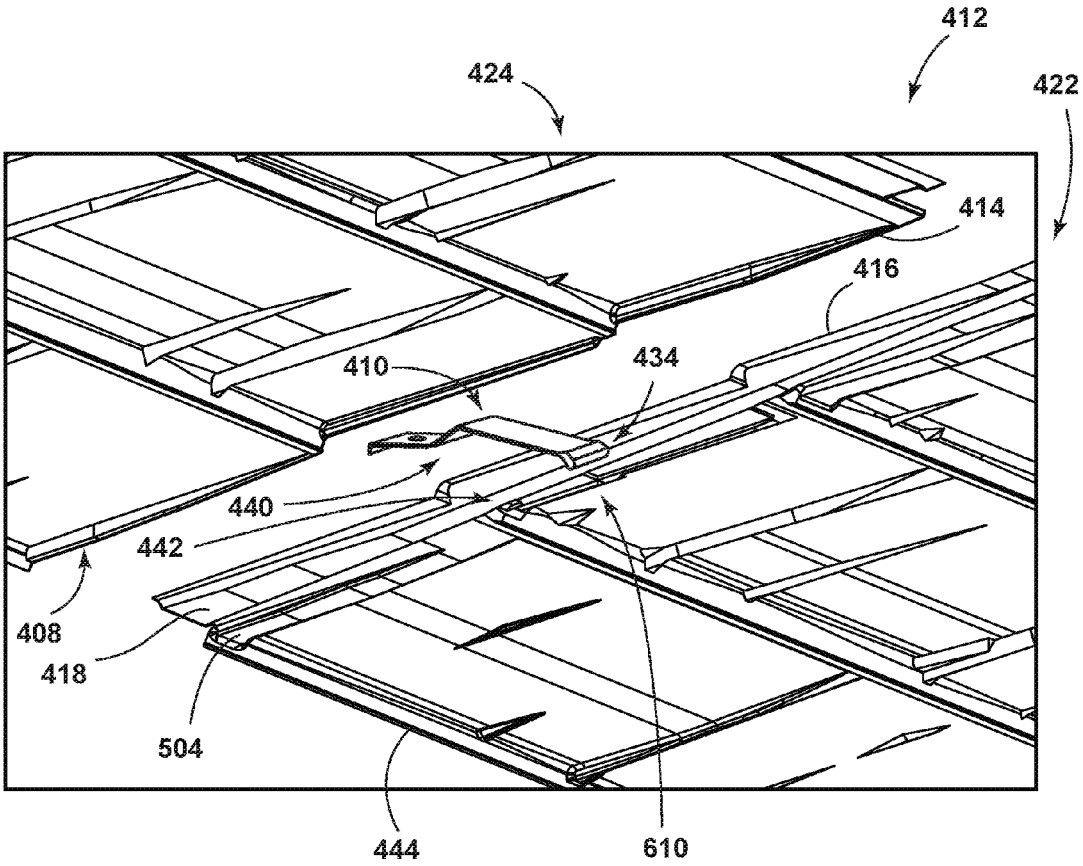
FIG. 37 is a partially exploded top perspective view of an embodiment of the interlocking metal roofing panel system showing a first adjacent modular roofing panel about to be installed upon another adjacent modular roofing panel with an attachment clip disposed therebetween.
Figure 38:
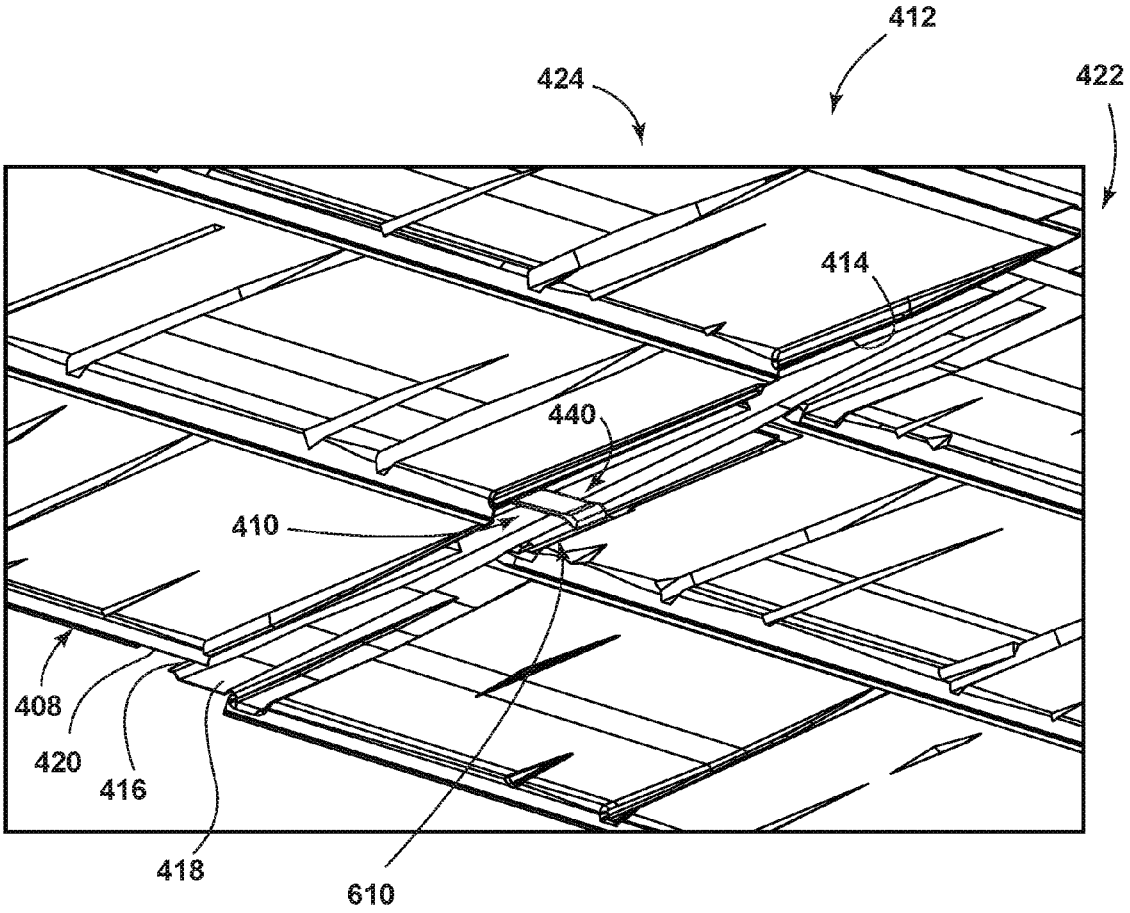
FIG. 38 is a partially exploded top perspective view of the interlocking metal roofing panel system of FIG. 37 with the first adjacent modular roofing panel about to be installed on the second adjacent modular roofing panel with the attachment clip installed therebetween.
Figure 39:
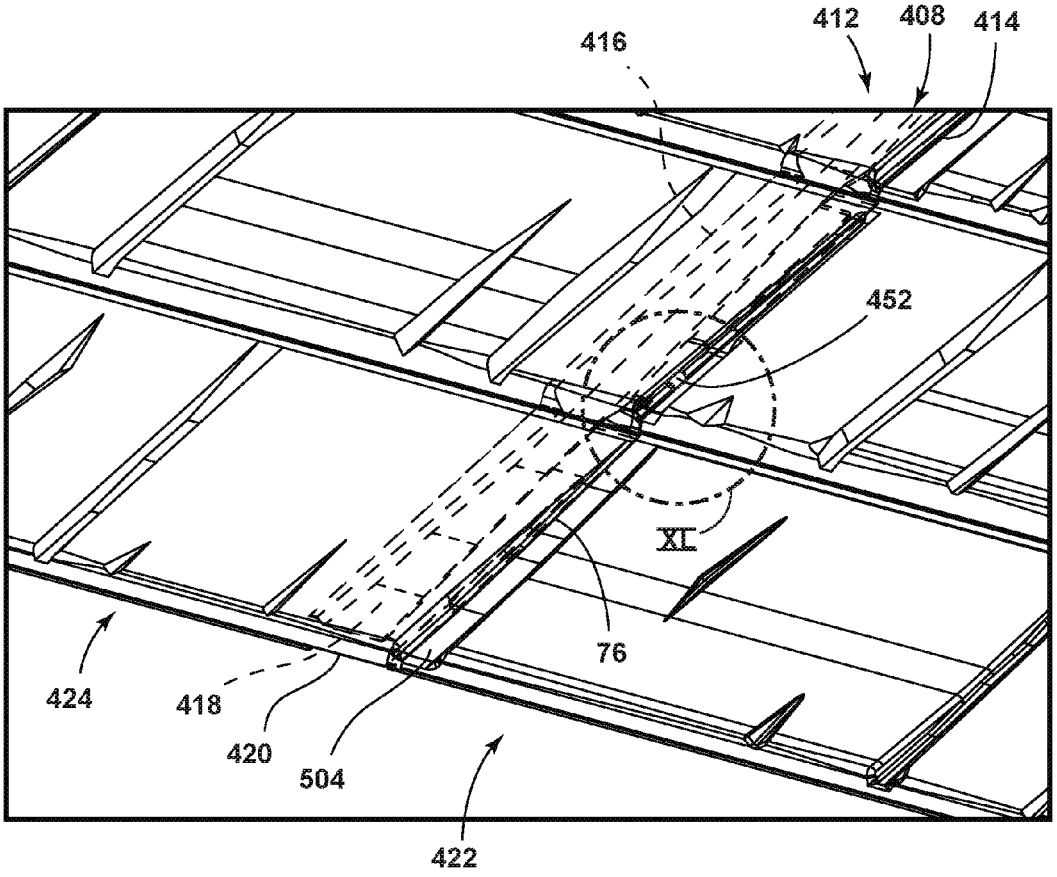
FIG. 39 is a top perspective view of the interlocking metal roofing panel system showing the first adjacent modular roofing panel installed upon the second adjacent modular roofing panel with the attachment clip holding the first and second modular roofing panels in an installed configuration.

Referring now to the embodiment illustrated in FIGS. 2 and 23, it is contemplated that the modular roof panel 10 can be manufactured such that it has one of several textures, colors finishes and other variable characteristics that can resemble various natural materials, such as slate tile, wood tile, shakes, thatch, cut stone, and other various natural materials. In addition, the modular roof panel 10 can be painted or otherwise colored to have any one of a plurality of finishes that are selected for use on the roof structure 46.

Referring now to the various embodiments illustrated in FIGS. 21-41, an interlocking metal roofing panel system 412 for installation upon a roof structure 46 is shown. It is contemplated that the structural features of the modular roof panels 10 illustrated in FIGS. 21-42 can be substantially similar to those illustrated in FIGS. 2-16. The features disclosed below are additional features that may be included in any one or more of the embodiments of the modular roof panels 10 and/or the interlocking metal roofing panel system 412. According to the various embodiments, the interlocking metal roofing panel system 412 can include a plurality of modular roof panels 10, where each modular roof panel 10 can include first and second side edges 414, 416, a drain channel 418 positioned proximate the first side edge 414, and a drain concealing portion 408 positioned proximate the second side edge 416. A first laterally adjacent metal roofing panel 422 and a second laterally adjacent metal roof panel 424 are installed, such that the second side edge 416 of the second laterally adjacent metal roofing panel 424 is selectively disposed over the drain channel 418 of the first laterally adjacent metal roofing panel 422. An adjacent downhill roof panel 406 is positioned under at least a portion of the first and second laterally adjacent roofing panels 422, 424. In this manner, the drain channel 418 of the first laterally adjacent metal roofing panel 422 is configured to be in communication with the drain concealing portion 408 and the second side edge 416 of the second laterally adjacent roof panel 424 and a top surface 438 of the adjacent downhill roof panel 406. An attachment clip 410 is positioned under the second side edge 416 of the second laterally adjacent roof panel 424 and over the drain channel 418 of the first laterally adjacent metal roofing panel 422. The attachment clip 410 includes a bridge portion 440 that spans over a portion of the drain channel 418 of the first laterally adjacent metal roofing panel 422 and also includes a compression section 434 that engages a receiving area 442 defined within the upper surface 436 of the first laterally adjacent metal roofing panel 422. It is also contemplated that each of the plurality of modular roofing panels 10 can include a lower edge 444 and a drain aperture 420 defined within the lower edge 444 proximate the second side edge 416 of each of the modular roof panels 10. It is contemplated that the drain aperture 420 of the second laterally adjacent roof panel 424 is configured to be in communication with the drain channel 418 of the first laterally adjacent metal roofing panel 422. Accordingly, the drain aperture 420 of the second laterally adjacent roof panel 424 places the top surface 438 of the adjacent downhill roof panel 406 in communication with the drain channel 418 of the first laterally adjacent metal roofing panel 422.

As shown in FIGS. 21-41, the interlocking metal roofing panel system 412 includes a plurality of modular roofing panels 10, each including the first and second side edges 414, 416. A drain channel 418 is disposed proximate the first side edge 414 and a drain aperture 420 is disposed proximate the second side edge 416 of each of the plurality of modular roofing panels 10. The drain channel 418 of a first laterally adjacent modular roofing panel 422 of the plurality of roofing panels is adapted to align with a drain aperture 420 of a second laterally adjacent metal roofing panel 424 of the plurality of modular roofing panels 10. The attachment clip 410 includes a leverage section 426 having a fulcrum 428 and a lever portion 430. The leverage section 426 is adapted to be attached to a roof structure 46 and positioned substantially under the second laterally adjacent metal roofing panel 424 such that the attachment of the leverage section 426 to the roof structure 46 at least partially rotates the lever portion 430 of the attachment about the fulcrum 428. The attachment clip 410 also includes a compression section 434, wherein the rotation of the lever portion 430 about the fulcrum 428 is adapted to downwardly press the compression section 434 on an upper surface 436 of the first laterally adjacent metal roofing panel 422 and a top surface 438 of the second laterally adjacent metal roofing panel 424. A bridge portion 440 of the attachment clip 410 extends between the leverage and compression sections 426, 434. The bridge portion 440 of the attachment clip 410 is adapted to extend above at least a portion of the drain channel 418 of the first laterally adjacent metal roofing panel 422. The bridge portion 440 also fits under the drain concealing portion 408 of the second laterally adjacent roofing panel 424.

Referring again to FIGS. 21-41, in the various embodiments, the compression section 434 of the attachment clip 410 can include an engagement portion 450 and a clipping member 452. The engagement portion 450 is adapted to engage the upper surface 436 of the first laterally adjacent metal roofing panel 422 and the clipping member 452 is adapted to engage the top surface 438 of the second laterally adjacent metal roofing panel 424. It is further contemplated that the bridge portion 440 of the attachment clip 410 can include a first angled portion 454 that extends upward from the leverage section 426 and a second angled portion 456 that extends upward from the compression section 434. In this manner, the first and second angled portions 454, 456 extend toward an apex 458 of the bridge portion 440.

Referring now to FIGS. 21, 22 and 36-41, in the various embodiments, the attachment clip 410 can include an elongate member 470 that includes first and second ends 472, 474 where the bridge portion 440 is disposed between the first and second ends 472, 474. The leverage section 426 of the attachment clip 410 can be attached at the first end 472 where a wall 476 of the leverage section 426 extends downward from the lever portion 430 to the fulcrum 428. In the various embodiments, at least a portion of the bridge portion 440 extends above the leverage section 426 to allow the bridge portion 440 to extend access and span over the drain channel 418. The compression section 434 of the attachment clip 410 is disposed proximate the second end 474 of the elongate member 470 where the clipping member 452 of the engagement portion 450 extends upward from the engagement portion 450 such that the clipping member 452 is above at least a portion of the engagement portion 450. It is also contemplated that at least a portion of the bridge portion 440 extends above the compression section 434.

Referring again to FIGS. 21, 22 and 36-41, in the various embodiments, the engagement portion 450 can include a third angled section 490 that extends downward from the second angled section of the bridge portion 440. It is contemplated that the third angled section 490 can be positioned at a steeper angle than the second angled section of the bridge portion 440. In this manner, when the attachment clip 410 is fixed to the roof structure 46 and the lever portion 430 is rotated at least partially around the fulcrum 428, the third angled portion acts as a riser to substantially prevent the bridge portion 440 from lowering into the drain channel 418 of the first laterally adjacent metal roofing panel 422. In this manner, the third angled section 490 of the engagement portion 450 maintains the bridge portion 440 in a position above the drain channel 418 to allow water running through the drain channel 418 of the first laterally adjacent metal roofing panel 422 to pass under the bridge portion 440 of the attachment clip 410 and through the drain aperture 420 of the second laterally adjacent metal roofing panel 424.

Referring again to FIGS. 21, 22 and 36-41, the lever portion 430 of the leverage section 426 can be a substantially planar member. Additionally, the lever portion 430 can be configured to be substantially horizontal to the roof structure 46 when the attachment clip 410 is placed upon the roof structure 46. In this manner, when the attachment clip 410 is fixed to the roof structure 46, the lever portion 430 is adapted to flex downward and radially about the fulcrum 428. This downward flexion of the lever portion 430 exerts a downward force 500 upon the compression section 434. This downward force 500 is transferred from the compression section 434 to the upper surface 436 of the first laterally adjacent metal roofing panel 422 such that the first laterally adjacent metal roofing panel 422 is pressed downward against the roof structure 46. In turn, when the second laterally adjacent metal roofing panel 424 is installed, the portion of the second laterally adjacent metal roofing panel 424 is disposed within the compression section 434 between the clipping member 452 and the engagement portion 450 of the compression section 434. In this manner, the downward force 500 causes the clipping portion of the engagement section to press down on at least a portion of the top surface 438 of the second laterally adjacent metal roofing panel 424 such that the second laterally adjacent metal roofing panel 424 is also pressed downward towards the first laterally adjacent metal roofing panel 422 and the roof structure 46.

Referring now to FIGS. 21, 22 and 36-41, it is contemplated that the fastening aperture 510 of the attachment clip 410 can include various shapes that include, but are not limited to, circular, rounded, elongated, oval, rectangular, irregular, or other shape that is adapted to receive a fastener 512 for attaching, securing, or otherwise coupling the attachment clip 410 to the roof structure 46. In embodiments of the attachment clip 410 where the fastening aperture 510 is elongated, the attachment clip 410 can be partially fastened to the roof structure 46 such that the attachment clip 410 can be moved along the fastener 512 through the elongated shape of the fastening aperture 510. The elongated shape of the fastening aperture 510 allows for positional adjustment of the attachment clip 410 to define a plurality of fastening positions of the attachment clip 510 before the fastener 512 is fully affixed to the roof structure 46 through the fastening aperture 510, thereby fixing the position of the attachment clip 410 onto the top surface 438 of the first laterally adjacent metal roofing panel 422.

In the various embodiments, with the attachment clip 410 being installed upon the roof structure 46 and the first laterally adjacent metal roofing panel 422 and the second laterally adjacent metal roofing panel 424 being installed within the compression section 434 of the attachment clip 410, the attachment clip 410 serves to provide the downward force 500 to the first and second laterally adjacent metal roofing panels 422, 424. In this manner, the attachment clip 410 can operate against uplift forces that may result from winds moving across and through the interlocking metal roofing panel system 412. Additionally, the attachment clip 410 is adapted to span the drain channel 418 of the first laterally adjacent metal roofing panel 422 while also providing the downward force 500 upon the first and second laterally adjacent metal roofing panels 422, 424 such that the attachment clip 410 does not interfere with the drain channel 418 and drain aperture 420 of the first and second laterally adjacent metal roofing panels 422, 424. In this manner, the drainage properties of the interlocking metal roofing panel system 412 are not diminished as a result of the various attachment clips 410 providing the downward forces 500 for the interlocking metal roofing panel system 412.

Referring again to FIGS. 21, 22 and 36-41, the fulcrum 428 of the leverage section 426 can be positioned at the end of the substantially planar wall 476 that is configured to be substantially perpendicular to the lever portion 430 of the leverage section 426. In this manner, the wall 476 raises the lever portion 430 of the leverage section 426 above the fulcrum 428, which rests upon the roof structure 46. Accordingly, when the lever portion 430 of the leverage section 426 is attached to the roof structure 46, the lever portion 430 is afforded the room to bend downward and substantially rotate about the fulcrum 428. This downward movement of the lever portion 430 provides the downward force 500 that is applied by the compression section 434 of the attachment clip 410. In the various embodiments, the engagement portion 450 of the compression section 434 is adapted to press down upon a portion of a surface channel 504 or other similar feature defined within the upper surface 436 of the first laterally adjacent metal roofing panel 422. In other embodiments, the engagement portion 450 can press down upon an upturned or raised portion of the first laterally adjacent metal roofing panel 422. It is further contemplated that the engagement portion 450 can press down upon a planar portion of the first laterally adjacent metal roofing panel 422, such as the receiving area 442 or a compression pocket 610 (as will be described more fully below) or other portion of the first laterally adjacent metal roofing panel 422).

Referring again to FIGS. 21, 22 and 36-41, in the various embodiments, the lever portion 430 of the leverage section 426 can include a substantially cambered member that is arched upward. Such a camber can be used to increase the distance that the lever portion 430 can rotate about the fulcrum 428 when the attachment clip 410 is installed upon the roof structure 46. In the various embodiments, the greater the distance that the lever portion 430 is allowed to rotate about the fulcrum 428, the greater the downward force 500 that the compression section 434 of the attachment clip 410 is allowed to exert upon the top surface 438 of the first and laterally adjacent metal roofing panels 422, 424. In various alternate embodiments, the lever portion 430 of the leverage section 426 can include various angled portions that are adapted to increase the distance that the lever portion 430 can rotate about the fulcrum 428. The increased distance serves to increase the downward force 500 that the compression section 434 can exert upon the first and second laterally adjacent metal roofing panels 422, 424.

Referring again to FIGS. 21, 22 and 36-41, the lever portion 430 of the leverage section 426 can include the fastening aperture 510 defined within the lever portion 430. In the various embodiments, the fastening aperture 510 can be of a sufficient size such that various fasteners 512 can be installed through the fastening aperture 510 to install the lever portion 430 upon the roof structure 46. The various fasteners 512 that can be used can include, but are not limited to, screws, nails, bolt and nut fasteners, and other similar fasteners that can be installed through the fastening aperture 510 and into the roof structure 46. In various embodiments, the fastening aperture 510 can include a smaller opening or indent such that the fastening aperture 510 provides a guide for the various fasteners 512 described above. In such an embodiment, as the fastener 512 is installed within the lever portion 430 of the leverage section 426, the fastener 512 used can tend to enlarge the opening of the fastening aperture 510 such that the fastener 512 can be substantially retained within the fastening aperture 510 of the lever portion 430. In various alternate embodiments, the lever portion 430 can be manufactured without a fastening aperture 510 such that the fastener 512 used is adapted to penetrate the lever portion 430 for installation upon the roof structure 46.

In various embodiments, it is contemplated that the wall 476 having the fulcrum 428 of the leverage section 426 can be disposed at an angle other than perpendicular relative to the lever portion 430 of the leverage section 426. It is further contemplated that the fulcrum 428 can be part of the lever portion 430 folded into a substantially triangular or peaked form to create the fulcrum 428 at a peak that extends downward from the lever portion 430. In the various embodiments, the fulcrum 428 can be disposed at an end of the lever portion 430 or within a central area of the lever portion 430. The location of the fulcrum 428 can be modified so long as the fastening aperture 510, or the location of the fastener 512 to be installed, is between the fulcrum 428 and the compression section 434 of the attachment clip 410. In this manner, the installation of the fastener 512 can serve to rotate the lever portion 430 about the fulcrum 428 in order to create the downward force 500 for the compression section 434 of the attachment clip 410.

Referring again to FIGS. 21, 22 and 36-41, the bridge portion 440 of the attachment clip 410 can include the first and second angled portions 454, 456 that meet at the apex 458 of the bridge portion 440. In this manner, the bridge portion 440 can be configured to span across the drain channel 418 of the first laterally adjacent metal roofing panel 422. In various alternate embodiments, the bridge portion 440 can include an arch that extends at least partially between the leverage section 426 and the compression section 434. In such an embodiment, at least a portion of the arch can be disposed above both the leverage and the compression sections 426, 434. It is also contemplated that the bridge portion 440 of the attachment clip 410 can include a plurality of angled portions that define various different geometries that can cooperate between the first and second laterally adjacent metal roofing panels 422, 424. These geometries can include, but are not limited to, polygonal, arcuate, irregular, combinations thereof, as well as other geometries that can be adapted to be installed between the first and second laterally adjacent metal roofing panels 422, 424. It is also contemplated that the bridge portion 440 of the attachment clip 410 can include additional alignment mechanisms that are configured to engage both the top surface 438 of the first laterally adjacent metal roofing panel 422 and the underside of the second laterally adjacent metal roofing panel 424. In this manner, the bridge portion 440 can substantially align the drain channel 418 of the first laterally adjacent metal roofing panel 422 and the drain aperture 420 of the second laterally adjacent metal roofing panel 424.

Referring again to FIGS. 21, 22 and 36-41, the first and second angled portions 454, 456 of the bridge portion 440 can be configured such that the apex 458 between the first and second angled portions 454, 456 is at the mid-point of the bridge portion 440. It is further contemplated that the first angled portion 454 can be inclined at a steeper angle than the second angled portion 456, wherein the first angled portion 454 is also shorter than the second angled portion 456. The exact configuration of the first and second angled portions 454, 456, as well as any other angled portions included within the bridge portion 440 of the attachment clip 410 can depend upon various factors that can include, but are not limited to, the width and depth of the drain channel, the height of the first and second laterally adjacent metal roofing panels 422, 424, the width of the attachment clip 410, as well as other factors.

Figure 40:
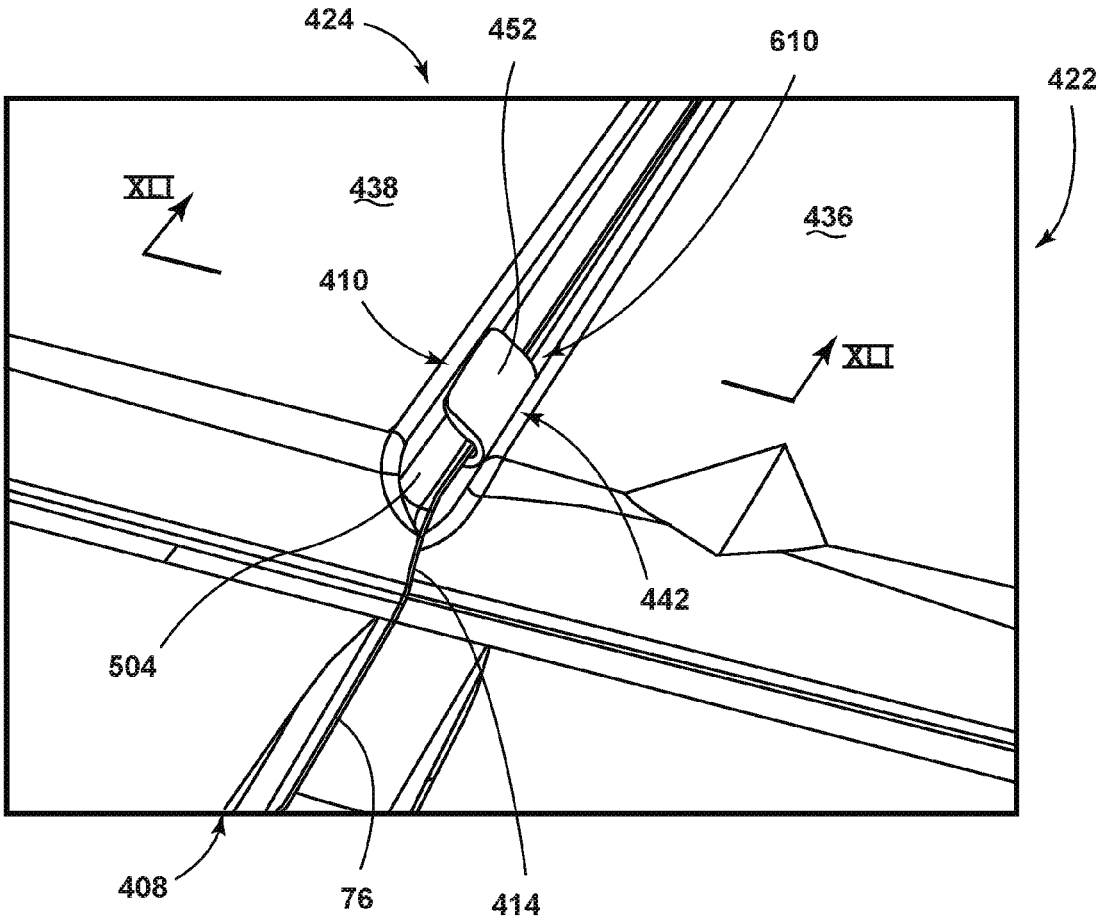
FIG. 40 is an enlarged top perspective view of the interlocking metal panel roofing system of FIG. 39 showing the engagement of the first and second modular roofing panels with the attachment clip disposed therebetween.
Figure 41:
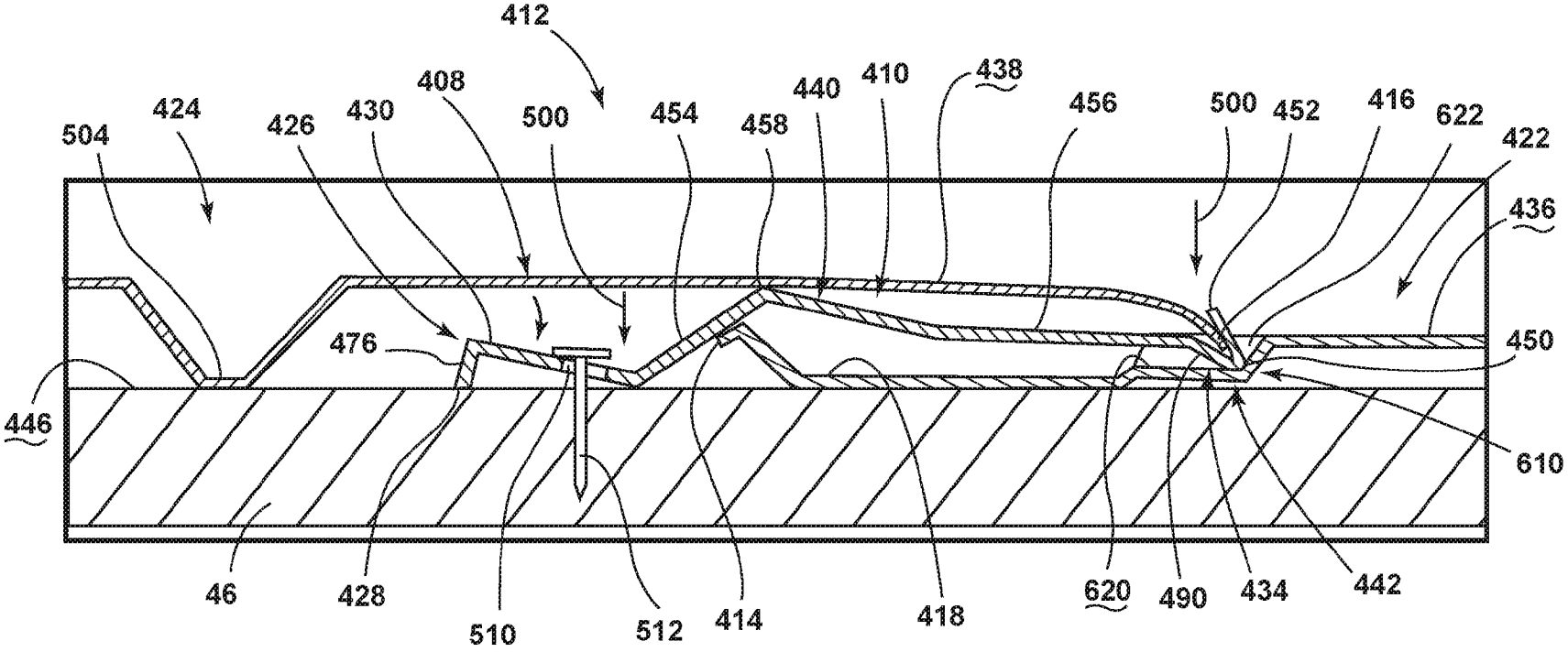
FIG. 41 is a cross-sectional view of the interlocking metal roofing panel system of FIG. 42 taken along line XLI.
Figure 42:
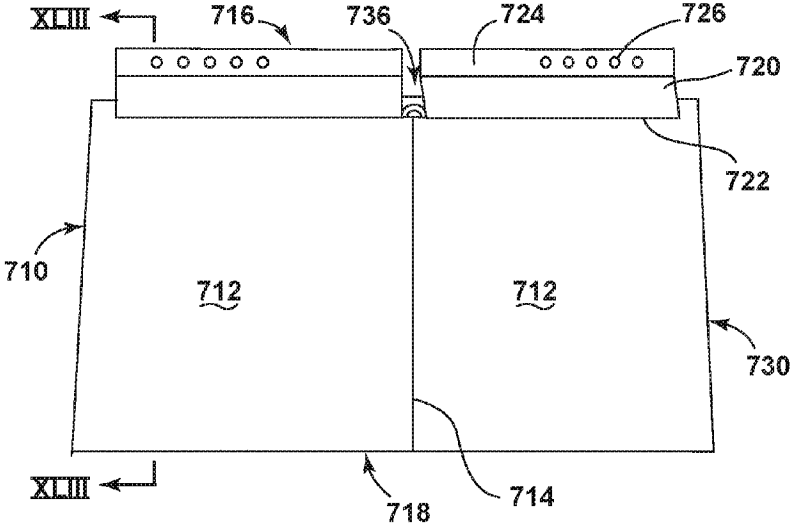
FIG. 42 is a top plan view of a ridge cap for the interlocking metal roofing panel system.
Figure 43:
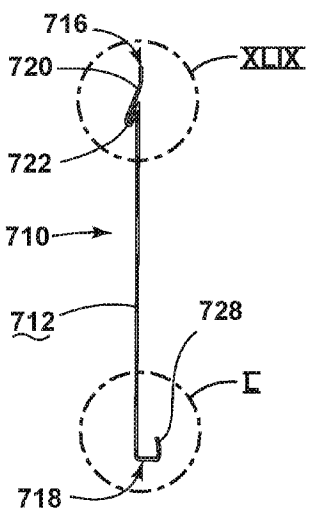
FIG. 43 is a cross-sectional view of the ridge cap of FIG. 42 taken along line XLIII-XLIII.
Figure 45:
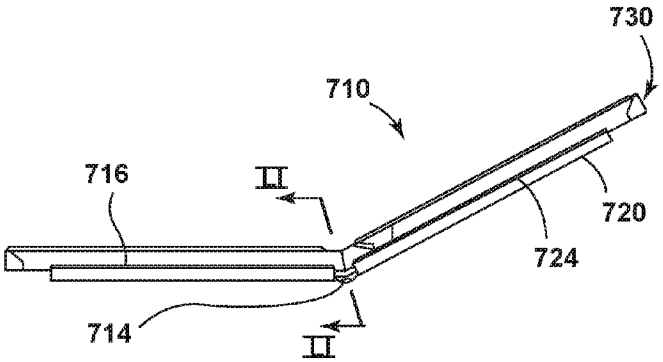
FIG. 45 is a second side elevational view of the ridge cap of FIG. 42.
Figure 44:
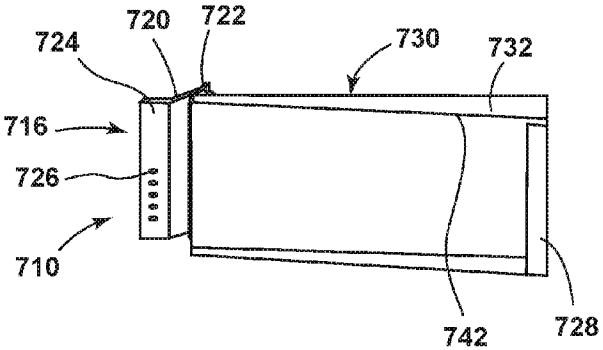
FIG. 44 is a side elevational view of the ridge cap of FIG. 42.
Figure 47:
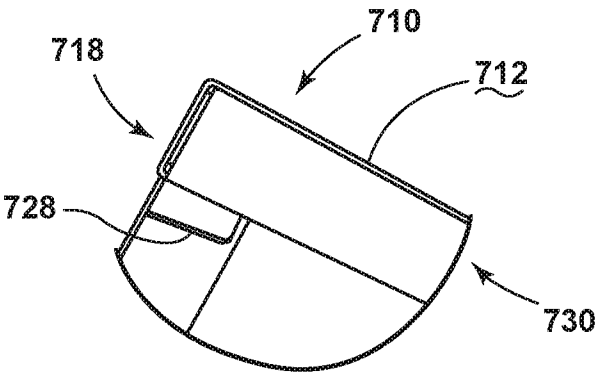
FIG. 47 is an enlarged side elevational view of the ridge cap of FIG. 44.
Figure 46:
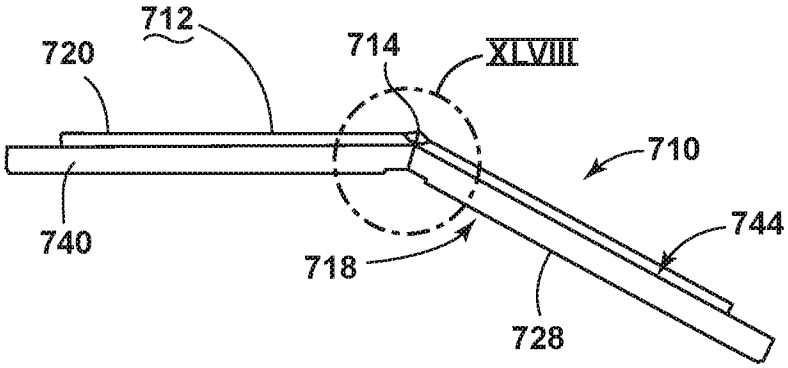
FIG. 46 is a third side elevational view of the ridge cap of FIG. 42.
Figure 48:
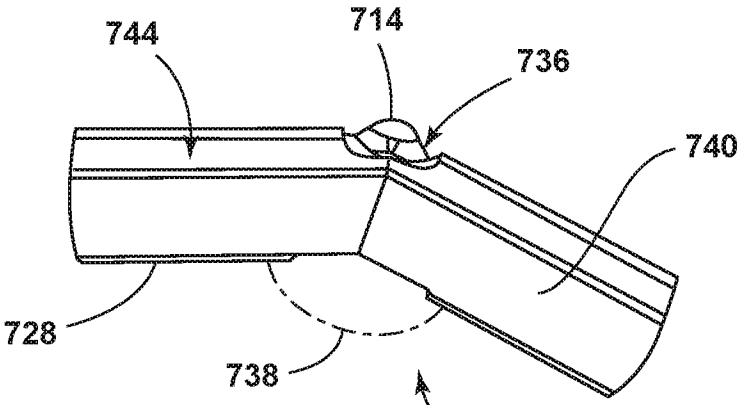
FIG. 48 is an enlarged elevational view of the ridge cap of FIG. 46 taken at area XLVIII.
Figure 50:
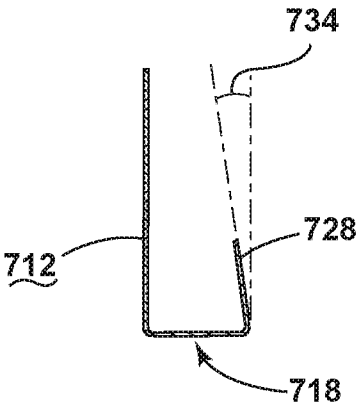
FIG. 50 is an enlarged cross-sectional view of the ridge cap of FIG. 43 taken at area L.
Figure 49:
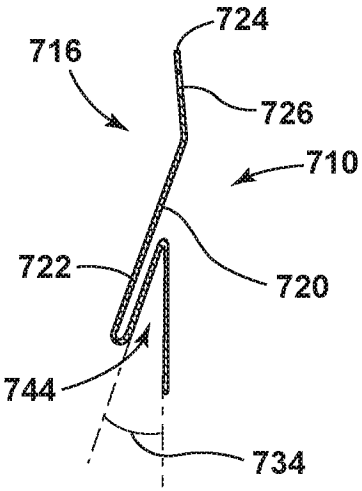
FIG. 49 is an enlarged cross-sectional view of the ridge cap of FIG. 43 taken at area XLIX.
Figure 51:
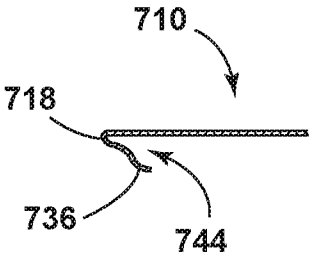
FIG. 51 is a cross-sectional view of the ridge cap of FIG. 45 taken along line LIII.

Referring now to FIGS. 40 and 41, in the various embodiments, it is contemplated that the only portion of the attachment clip 410 that is visible from the exterior of the interlocking metal roofing panel system 412 is a portion of the clipping member 452 of the compression section 434. In this manner, the attachment clip 410 can provide the various functions that include providing a downward force 500 upon the first and second laterally adjacent metal roofing panels 422, 424 and not interfering with the drainage capabilities of the interlocking metal roofing panel system 412. These functions can be provided while also having a minimal aesthetic effect upon the interlocking metal roofing panel system 412. In various embodiments, a surface of the clipping member 452 can be modified to substantially match the surface of the plurality of metal roofing panels such that the clipping member 452 can be further concealed within the interlocking metal roofing panel system 412. In the various embodiments, it is contemplated that various corners of the clipping member 452 as well as other corners of the attachment clip 410 can be rounded or chamfered to provide additional aesthetics for the attachment clip 410 when installed with the interlocking metal roofing panel system 412.

Figure 54:
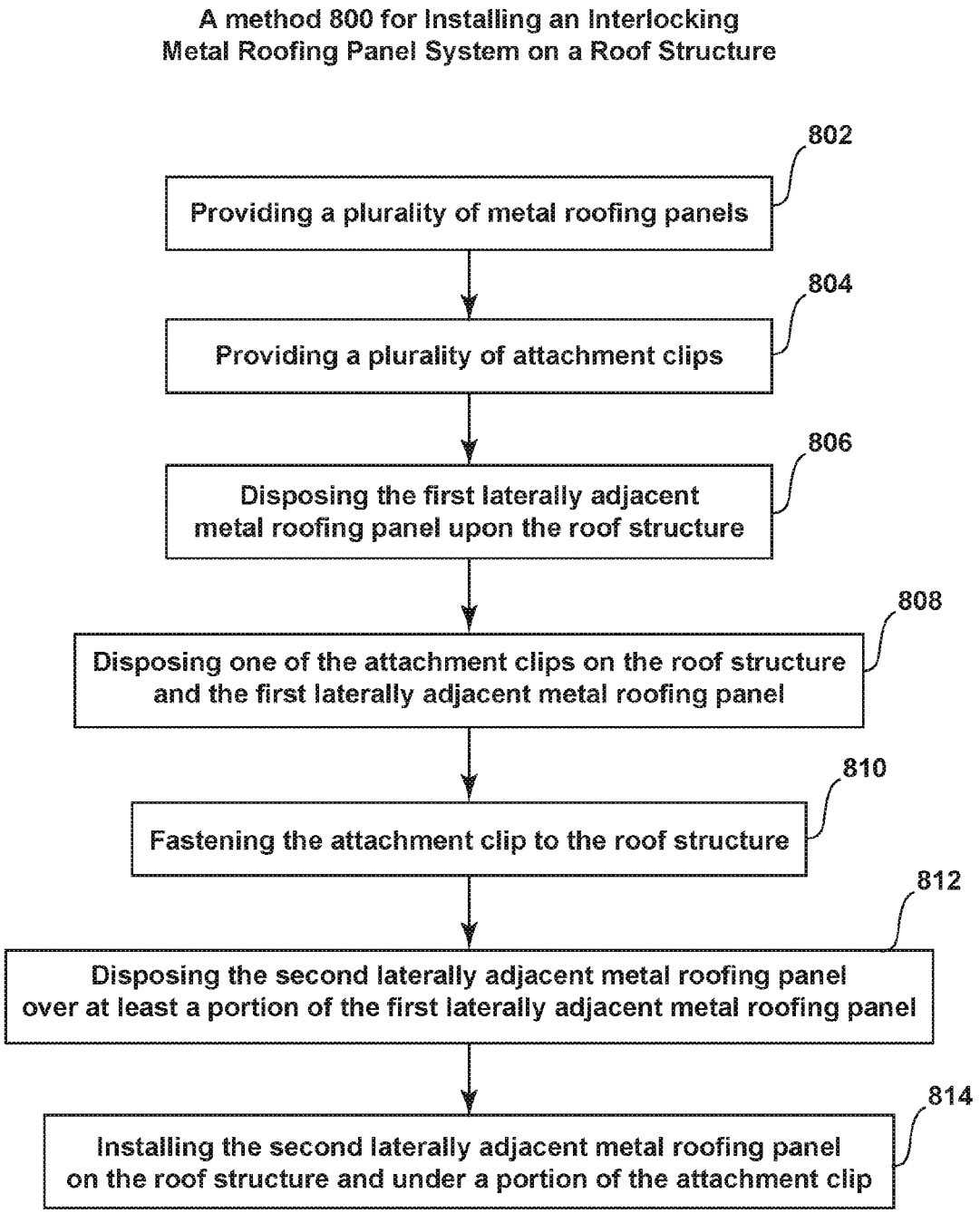
FIG. 54 is a schematic linear flow diagram illustrating a method for installing a modular roof panel system upon a roof structure.

Referring now to FIG. 54 and having described the attachment clip 410 and how the various portions of the attachment clip 410 relate to the first and second laterally adjacent metal roofing panels 422, 424 and the interlocking metal roofing panel system 412 as a whole, a method is disclosed for installing an interlocking metal roofing panel system 412 on a roof structure 46. A first step of the method 800 includes providing a plurality of modular roofing panels 10 (step 802), where each modular roofing panel 10 includes first and second side edges 414, 416, a drain channel 418 disposed proximate the first side edge 414, and a drain aperture 420 disposed proximate the second side edge 416. In this manner, the drain channel 418 of the first laterally adjacent metal roofing panel 422 is adapted to substantially align with the drain aperture 420 of the second laterally adjacent metal roofing panel 424. An attachment clip 410 is also to be provided (step 804), where the attachment clip 410 includes a leverage section 426 having a fulcrum 428 and a lever portion 430. The attachment clip 410 also includes a compression section 434 having an engagement portion 450 and a clipping member 452. A bridge portion 440 of the attachment clip 410 is adapted to extend between the leverage and compression sections 426, 434. Once the plurality of metal roofing panels and the attachment clips 410 are provided, the first laterally adjacent metal roofing panel 422 is disposed upon the roof structure 46 (step 806).

In the various embodiments of the method 800 and apparatus described above, the designation of the first laterally adjacent metal roofing panel 422 and second laterally adjacent metal roofing panel 424 simply refers to the relationship of two adjacent metal roofing panels. The relationship of the first laterally adjacent metal roofing panel 422, the attachment clip 410 and the second laterally adjacent metal roofing panel 424 is repeated throughout each such connection of the interlocking metal roofing panel system 412.

Referring again to FIG. 54, once the first laterally adjacent metal roofing panel 422 is disposed on the roof structure 46, an attachment clip 410 is disposed on the roof structure 46 and the first laterally adjacent metal roofing panel 422 (step 808). The compression section 434 of the attachment clip 410 is disposed on an upper surface 436 of the first laterally adjacent metal roofing panel 422 and the bridge portion 440 is adapted to extend across and above at least a portion of the drain channel 418 of the first laterally adjacent metal roofing panel 422. The leverage section 426 of the attachment clip 410 is positioned distal from the first laterally adjacent metal roofing panel 422 such that the fulcrum 428 of the leverage section 426 substantially engages the upward top surface 446 of the roof structure 46. It is contemplated that in various embodiments, an underlayment such as tar paper, felt, or other similar bituminous covering is disposed upon the roof structure 46 and the attachment clip 410 is disposed upon the bituminous layer. Once the attachment clip 410 and the first laterally adjacent metal roofing panel 422 are in position, the leverage section 426 of the attachment clip 410 is fastened to the roof structure 46 (step 810). It is contemplated that the attachment of the leverage section 426 causes the lever portion 430 to rotate about the fulcrum 428. The rotation of the lever portion 430 about the fulcrum 428 serves to downwardly press the engagement portion 450 of the compression section 434 on an upper surface 436 of the first laterally adjacent metal roofing panel 422. In this manner, the first laterally adjacent metal roofing panel 422 is pressed by the engagement portion 450 against the roof structure 46. Once the leverage section 426 of the attachment clip 410 is fastened to the roof structure 46, the second laterally adjacent metal roofing panel 424 is disposed over at least a portion of the first laterally adjacent metal roofing panel 422 such that the drain aperture 420 of the second laterally adjacent metal roofing panel 424 substantially aligns with the drain channel 418 of the first laterally adjacent metal roofing panel 422 (step 812). Additionally, a portion of the second laterally adjacent metal roofing panel 424 is disposed under the clipping member 452 of the compression section 434. In this manner, the clipping member 452, as a result of the downward force 500 created by the lever portion 430 rotating about the fulcrum 428, is pressed downward onto the first laterally adjacent metal roofing panel 422 as well as the roof structure 46. Once the second laterally adjacent metal roofing panel 424 is installed (step 814), the bridge portion 440 of the attachment clip 410 remains positioned above the drain channel 418 of the first laterally adjacent metal roofing panel 422. Accordingly, the bridge portion 440 of the attachment clip 410 is positioned such that it does not interfere with the drainage properties of the interlocking metal roofing panel system 412.

In the various embodiments, it is contemplated that the attachment clip 410 can be made of various rigid but elastic materials that tend to retain a predetermined form. Such materials can include, but are not limited to, spring steel, various other steel alloys, other metals, plastic, polymers, composites, as well as other substantially rigid but elastic materials. The elastic properties of the attachment clip 410 serve to provide the downward force 500 of the compression section 434 when the lever portion 430 is attached to the surface of the roof structure 46 and at least partially rotated about the fulcrum 428 of the leverage section 426.

Referring again to FIGS. 23-43, another aspect of the metal roofing panel for the interlocking metal roofing panel system 412 is contemplated. Proximate the drain channel 418 disposed along the first side edge 414 of the metal roofing panel, a compression pocket 610 is defined within the upper surface 436 of the modular roof panel 10, proximate the receiving area 442, and is adapted to receive the compression section 434 of the attachment clip 410. The compression pocket 610, according to various embodiments, is set lower within the upper surface 436 of the metal roofing panel than at least a portion of the areas surrounding the compression pocket 610. It is contemplated that, in various embodiments, the drain channel 418 of the metal roofing panel is set lower within the upper surface 436 of the metal roofing panel than the compression pockets 610. Due to the compression pocket 610 being set deeper within the upper surface 436 of the metal roofing panel, the lever portion 430 of the attachment clip 410 can rotate further about the fulcrum 428 of the attachment clip 410 to further downwardly press the compression section 434 onto the upper surface 436 of the metal roofing panel. The additional distance provided by the compression pocket 610 within which the lever portion 430 can rotate, provides a more secure fit of the compression section 434 within the compression pocket 610 of the metal roofing panel.

Referring again to FIGS. 23-43, because the compression pocket 610 is set deeper within the upper surface 436 of the metal roofing panel, the clipping member 452 of the attachment clip 410 is also set deeper within the metal roofing panel. In this manner, the second side edge 416 of the second laterally adjacent metal roofing panel 424 that is set within the clipping member 452 of the engagement portion 450 of the attachment clip 410 can be drawn tighter in a downward direction onto the upper surface 436 of the first laterally adjacent metal roofing panel 422. Accordingly, the compression pocket 610 causes a tighter and more secure fit between the first laterally adjacent metal roofing panel 422 and the second laterally adjacent metal roofing panel 424 to further prevent uplift of the overlapping second laterally adjacent metal roofing panel 424 caused by high winds moving across the upper surface 436 of the interlocking metal roofing panel system 412.

Referring again to the embodiment illustrated in FIGS. 23-43, the compression pocket 610 of the receiving area 442 includes a compression-receiving surface 620 that is defined by a portion of the upper surface 436 of the metal roofing panels. The compression-receiving surface 620 is surrounded by a plurality of positioning walls 622 that extend upward from the compression-receiving surface 620 to higher and adjacent areas surrounding the compression pocket 610. The positioning walls 622 of the compression pocket 610 are adapted to locate the engagement portion 450 of the attachment clip 410 onto the first laterally adjacent metal roofing panel 422 within a predetermined position defined by the compression pocket 610. As illustrated, the compression pocket 610 and the positioning walls 622 are located proximate a middle course 624 defined within the metal roofing panel. According to the various embodiments, the compression pocket 610 should be located in a position that maximizes the downward force 500 placed upon the upper surface 436 of the first laterally adjacent metal roofing panel 422 by the engagement portion 450 of the attachment clip 410. The position of the compression pocket 610 should also be located to minimize any potential crushing, bending, deformation, or other deflection of the first laterally adjacent metal roofing panel 422 caused by the downward force 500 of the engagement portion 450 of the attachment clip 410 pressing down on the compression pocket 610 of the first laterally adjacent metal roofing panel 422. According to the various embodiments, the exact positioning of the compression pocket 610 can vary depending upon the exact design of the interlocking metal roofing panel system 412. Such factors that can determine the proper location of the compression pocket 610 can include, but are not limited to, the number of courses within the metal roofing panel, the shape of the metal roofing panel, the material used in the formation of the metal roofing panel, the thickness of the metal roofing panel, the width of the drain channel 418 of the metal roofing panel, and other factors.

According to the various embodiments, the compression pocket 610 of the receiving area 442 of the roofing panel 10 is adapted to provide a guide for positioning the attachment clip 410 relative to the roof structure 46 and the first laterally adjacent metal roofing panel 422. It is contemplated that the positioning walls 622 of the compression pocket 610 are configured to be wider than the attachment clip 410, in various embodiments, such that the attachment clip 410 is afforded a certain amount of play or positional movement upon both the first laterally adjacent metal roofing panel 422 and the roof structure 46 in order to provide for a limited range of placement positions of the attachment clip 410 relative to the roof structure 46 and the first laterally adjacent metal roofing panel 422. The wider configuration of the compression pocket 610 can allow for situations where the fastening aperture 510 may be located proximate a less-than-optimal fastening position within the roof structure 46, such as a joint between plywood panels of the roof structure 46, a roof vent, or some other similar structural, mechanical, or electrical fixture positions near the attachment clip 410. When the attachment clip 410 is positioned near such a less-than-optimal position, the wider configuration of the compression pocket 610 allows the attachment clip 410 to be moved in a variety of lateral directions to substantially avoid the less-than-optimal position while also providing the requisite downward force 500 onto the compression-receiving surface 620 of the compression pocket 610.

According to various embodiments, the compression-receiving surface 620 of the compression pocket 610 can include a limited slope that extends downward toward the drain channel 418. In this manner, the sloped surface of the compression-receiving surface 620 of the compression pocket 610 can be configured to direct any fluid or debris that may enter into the compression pocket 610 down into the drain channel 418 for evacuation from the interlocking metal roofing panel system 412. As such, the receiving area 442 defines a recess within the upper surface 436 of the modular roof panel 10 that is in communication with the drain channel 418. This recess can be in the form of the compression pocket 610.

According to the various embodiments, it is contemplated that the compression pocket 610 can be included within metal roofing panels having various textured finishes. Such roofing panels can include a shake roofing panel (as illustrated in FIG. 2) or a slate tile metal roofing panel (as illustrated in FIG. 23). Additionally, in various embodiments, the compression pocket 610 can be incorporated into metal roofing panels having alternate relief patterns and textures as well as different numbers of courses 26 defined within the top surface 438 of the metal roofing panel.

Referring again to the embodiment illustrated in FIGS. 17-20, a panel end cap 650 for the interlocking metal roofing panel system 412 for concealing the first or second side edges 414, 416 of various metal roofing panels that are positioned at the outer edges of the roof structure 46. In this manner, the panel end cap 650 can be used to conceal the drain channel 418, and at least a portion of the compression pocket 610 that may be disposed at one of the outer edges of the roof structure 46 and for which no overlapping second laterally adjacent metal roofing panel 424 can be used to conceal these portions of a first laterally adjacent metal roofing panel 422. The panel end cap 650 can include an elongated base 652 that extends substantially the length of each of the metal roofing panels. A backturned portion 654 of the panel end cap 650 includes an upper portion 656 that is finished in substantially the same manner as the remainder of the top surface 438 of the metal roofing panels of the interlocking metal roofing panel system 412. In this manner, the upper portion 656 of the backturned portion 654 of the panel end cap 650 can be used to conceal portions of the top surface 438 of the metal roofing panels, such as the drain channel 418, or any edge where a portion of the metal roofing panel may have been cut or otherwise manipulated to match the shape of the roof structure 46. The backturned portion 654 of the panel end cap 650 includes substantially the same relief configuration as the metal roofing panels. Accordingly, where the metal roofing panels include a plurality of sloped courses 26, the backturned portion 654 of the panel end cap 650 will, similarly, include a similar profile having the same number of sloped courses 26. As such, the backturned portion 654 of the panel end cap 650 can be conveniently slid over the top surface 438 of the metal roofing panels such that the profiles of the metal roofing panel and the panel end cap 650 substantially match.

Referring again to the embodiments illustrated in FIGS. 17-20, the backturned portion 654 of the panel end cap 650 can define an internal area 658 that extends beneath the backturned portion 654 of the panel end cap 650 but above the base 652 of the panel end cap 650 disposed below the backturned portion 654. According to the various embodiments, the backturned portion 654 is located downward from a top edge 660 of the panel end cap 650 such that the area proximate the top edge 660 of the panel end cap 650 includes only the base 652 and no backturned portion 654. In this manner, the top portion of the panel end cap 650 is adapted to receive an adjacent panel end cap 662 that can be placed upon the base 652 of the panel end cap 650 previously laid on the roof structure 46. Additionally, each panel end cap 650 can include a locating tab 664 disposed at the bottom edge 666 of the panel end cap 650. The locating tab 664 of the panel end cap 650 can be used to slide into the internal area 658 defined between the backturned portion 654 and the base 652 of an adjacent panel end cap 662. In this manner, a series of panel end caps 650 can be disposed along an edge of the roof structure 46 to conceal the edges of a plurality of metal roofing panels that may have rough cut edges that require concealment for aesthetic purposes.

Referring again to the embodiment illustrated in FIGS. 17-20, each panel end cap 650 can include a backturned flange 668 that is disposed at an edge opposite the backturned portion 654 of the panel end cap 650. According to the various embodiments, the backturned flange 668 can be used as a secondary locating device for positioning two vertically adjacent panel end caps 662 in relation to one another. Similar to the backturned portion 654, the backturned flange 668, according to various embodiments, may not extend to the top edge 660 of the panel end cap 650. In such embodiments, the bottom portion of the backturned flange 668 can be disposed on top of the base 652 of the adjacent metal end cap that was installed previously. Accordingly, the backturned flanges 668 of the two adjacent panel end caps 662 can substantially abut in order to locate the two panel end caps 650 relative to one another. According to various embodiments, it is contemplated that two adjacent backturned flanges 268 can also overlap one another in order to position the two panel end caps 650 relative to one another.

With reference yet again to FIGS. 17-20, the base portion 652 of the panel end cap 650 can include one or more raised portions 670 that define an end cap drain channel 672 that is adapted to allow fluid and debris that may infiltrate the panel end cap 650 to run down along the plurality of panel end caps 650 to be expelled from the interlocking metal roofing panel system 412. The end cap drain channel 672 can be defined by two opposing raised portions 670 with a planar portion extending therebetween, such that the opposing raised portions 670 substantially direct fluid and debris that may become entrapped within the panel end cap 650 in a downward direction over the top surface 438 of the plurality of panel end caps 650 disposed upon the roof structure 46. It is also contemplated that the one or more raised portions 670 that are used to define the drain channel 418 may also be used as locating devices for the adjacent panel end caps 662 to properly position the panel end caps 650 relative to one another.

In the various embodiments, as illustrated in FIGS. 17-20, it is contemplated that the backturned portion 654 of the panel end cap 650 can also define a drain slot 674 proximate the bottom edge 666 of the panel end cap 650 that can cooperate with a drain channel 418 of the modular roof panels 10. In situations where a drain channel 418 is disposed at an outer edge of the roof structure 46, the backturned portion 654 can be used to extend over the drain channel 418 of the modular roof panel 10 to substantially conceal the drain channel 418. In order to allow the drain channel 418 to properly function to remove water from the interlocking metal roofing panel system 412, the lower edges of each of the modular roof panels 10 can define the drain slot 674 defined between the backturned portion 654 and base portion 652 of the panel end cap 650. Accordingly, the drain slot 674 can be used to cooperate with the drain channel 418 of the modular roof panel 10 to substantially allow water to be expelled through the drain channel 418 and under the backturned portion 654 and through the internal area 658 of the panel end cap 650 to be expelled from the interlocking metal roofing panel system 412.

Referring now to FIGS. 42-53, the interlocking metal roofing panel system 412 includes a ridge cap 710 that is configured to extend over topmost edge 708 of various modular roof panels 10 that are disposed near the ridge 132 of a roof structure 46 (shown in FIG. 1). In this manner, the various ridge caps 710 disposed upon the ridge 132 of the roof structure 46 are configured to conceal the topmost edges 708 of these modular roof panels 10 disposed near the ridge 132. Each ridge cap 710 includes two opposing ridge cap surfaces 712 that meet at a ridge cap apex 714, wherein each of the opposing ridge cap surfaces 712 descend downward from the ridge cap apex 714. Each of the opposing ridge cap surfaces 712 includes first and second longitudinal edges 716, 718 that extend perpendicularly from the ridge cap apex 714. The first longitudinal edge 716 of the ridge cap 710 includes a receiving flange 720 that is defined by a rolled back portion 722 of each of the opposing ridge cap sides. The receiving flange 720 is bent backward over the ridge cap 710 at a predetermined angle 734 and then bent over itself such that the receiving flange 720 extends beyond the opposing ridge cap sides to define an attachment flange 724 of the ridge cap 710. The attachment flange 724 of the ridge cap 710 can include a plurality of apertures 726 that are adapted to receive fasteners that attach the ridge cap 710 to the roof structure 46 proximate the ridge 132. The second longitudinal edge 718 of the ridge cap 710 includes a downturned portion 728 that is adapted to engage the receiving flange 720 of the first longitudinal edge 716 of a laterally adjacent ridge cap 710. According to various embodiments, the downturned portion 728 of the ridge cap 710 disposed at the second longitudinal edge 718 can be turned at an angle that can substantially cooperate with the predetermined angle 734 of the receiving flange 720 defined by the first longitudinal edge 716 of a laterally adjacent ridge cap 710. In this manner, the downturned portion 728 and the receiving flange 720 can cooperate to substantially lock two adjacent ridge caps 710 together along the ridge 132 of the roof structure 46. The predetermined angle 734 of the downturned edge and the predetermined angle 734 of the receiving flange 720 can also cooperate with lower lateral edges 730 of the ridge cap 710 that include a tapered portion 732 that sets the ridge cap 710 upon the roof structure 46 at the predetermined angle 734. The predetermined angles 734 of the first and second longitudinal edges 716, 718 and the lateral edge 730 are adapted to position each ridge cap 710 at an angle descending from the second lateral edge 730 to the first lateral edge 730 such that adjacent ridge caps 710 can be overlapped without increasing the thickness of the various ridge caps 710 as they extend along the ridge 132 of the roof structure 46.

Referring again to the embodiment illustrated in FIGS. 42-53, the first longitudinal edge 716 of the ridge cap 710 proximate the apex 714 of the ridge cap 710 defines a gap 736 disposed between the first longitudinal edges 716 of the opposing ridge cap surfaces 712. The gap 736 between the opposing ridge cap surfaces 712 allows for the ridge cap 710 to be bent such that the opposing ridge cap surfaces 712 are able to be disposed at different apex angles 738 to match the various slopes of the roof structure 46. The gap 736 between the two attachment flanges 724 of the opposing ridge cap surfaces 712 allows each attachment flange 724 of the opposing ridge cap surfaces 712 to be individually attached to the roof structure 46. Accordingly, the attachment of one attachment flange 724 to the roof structure 46 will not substantially interfere with the attachment of the attachment flange 724 of the opposing ridge cap surface 712. Similarly, the second longitudinal edge 718 of the ridge cap 710 at the downturned portion 728 includes opposing vertical surfaces 740 that extend downward from the ridge top surfaces 712 of the ridge cap 710. Each of the opposing ridge cap surfaces 712 includes its own vertical surface 740 that extends downward. At the apex 714, the two vertical surfaces 740 are configured to overlap to substantially close off any opening that may exist between the two opposing ridge cap surfaces 712 as the two ridge cap surfaces 712 are disposed at the apex angle 738 to match the ridge 132 of the roof structure 46. Because of the overlapping configuration of the vertical profile portions of the second longitudinal edge 718, the various ridge caps 710 can be overlapped along the ridge of the roof structure 46 with only the potential for a minute opening existing between the opposing ridge cap surface 712 to provide the aesthetic of a wood shake or slate tile ridge cap 710 being disposed upon the ridge of the roof structure 46.

Referring once again to the embodiment illustrated in FIGS. 42-53, the lateral edges 730 of the ridge cap 710 include lateral profile surface that extend downward from lower lateral edges 730 of each of the opposing ridge cap surfaces 712. The lateral profile edges 742 of the ridge cap 710 are substantially angled relative to the ridge cap surfaces 712 to define the tapered portions 732. The tapered portions 732 have a decreasing height extending from the second longitudinal edge 718 to the first longitudinal edge 716. In this manner, the height of the lateral profile edge 742 at the second longitudinal edge 718 substantially matches the height of the lateral profile edge 742 at the second longitudinal edge 718.

Figure 52:
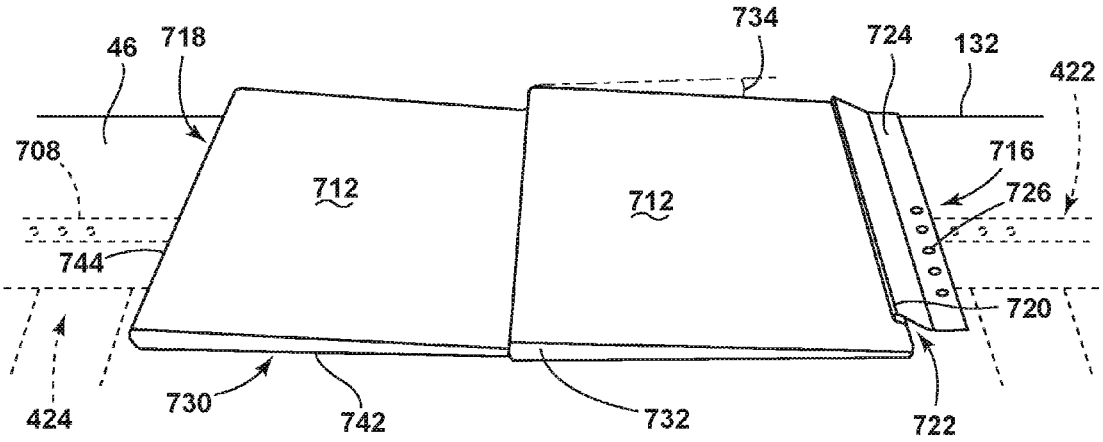
FIG. 52 is a top perspective view of two adjacent ridge caps of an embodiment of the interlocking metal roofing panel system shown installed upon a roof structure.
Figure 53:
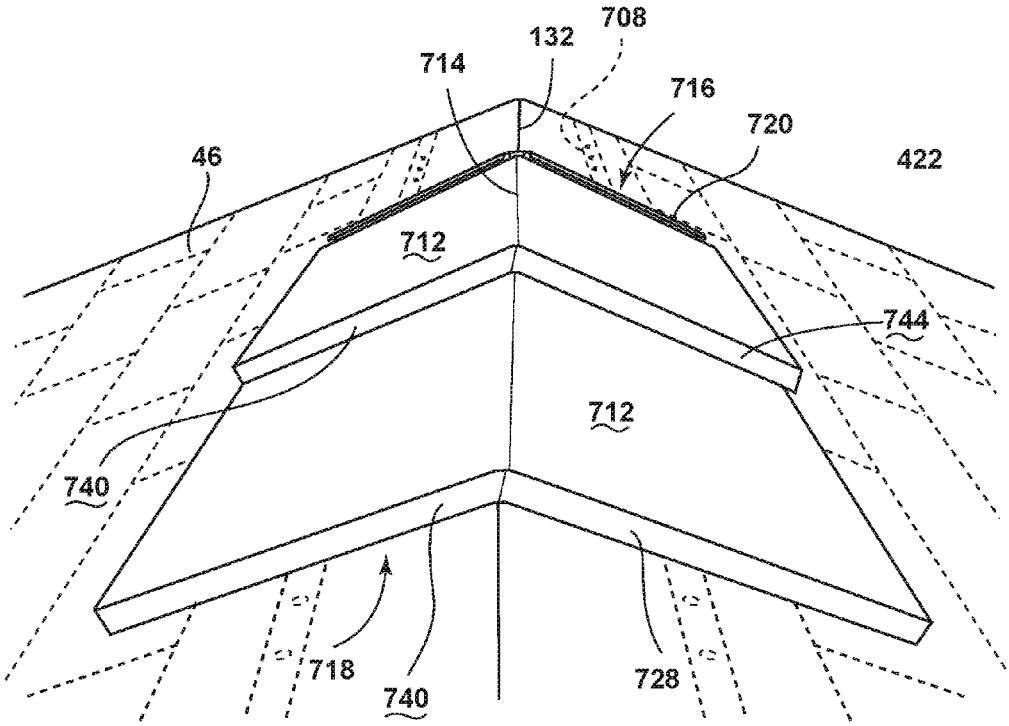
FIG. 53 is a top perspective view of the ridge caps of FIG. 52 shown installed upon a roof structure.

Referring now to FIGS. 52 and 53, as the various ridge caps 710 are disposed upon the ridge of the roof structure 46, each ridge cap 710 is placed on top of the previously installed ridge cap 710 to create a continuous ridge cap assembly that provides a visual appearance of wood shakes, slate tiles or other material aesthetic. As discussed previously, the angle of the downturned portion 728, the receiving flange 720, and the tapered configuration of the lateral profile edges 742 allow for each ridge cap 710 to be disposed substantially flush upon the roof structure 46 at the ridge 132 so that each ridge cap 710 includes a tapered profile that extends downward and into the overlapping ridge cap 710 disposed thereon. In this manner, as fluid and debris fall upon each ridge cap 710, water is directed substantially perpendicular to the ridge cap apex 714 of each ridge cap 710 and down the opposing ridge cap surfaces 712 toward the upper surface 436 of the various metal roofing panels disposed below each of the ridge caps 710. It is contemplated that a limited amount of water may extend below the downturned portion 728 of the laterally adjacent ridge cap 710. Any fluid and/or debris that does extend below the downturned portion 728 of the laterally adjacent ridge cap 710 is adapted to be captured by the ridge cap channel 744 defined below the receiving flange 720 of the ridge cap 710. Once entrapped by the ridge cap channel 744 below receiving flange 720 of the ridge cap 710, water is directed downward through the ridge cap channel 744 and is expelled from the ridge cap 710 and onto the top surface 438 of the various metal roofing panels disposed upon the roof structure 46.

Referring again to FIGS. 42-53, the tapered profile of each ridge cap 710 as it is disposed on top of the ridge of the roof structure 46 allows each subsequent ridge cap 710 to be disposed on top of a previously installed ridge cap 710 without increasing the thickness of the ridge cap 710 of the interlocking metal roofing panel system 412. Stated another way, the apex 714 of each of the ridge caps 710 is disposed substantially the same distance from the roof structure 46 as each of the other ridge caps 710. This aesthetic substantially mimics the look of a wood shake roof or a slate tile roof, or other similar material aesthetic.

It will be understood by one having ordinary skill in the art that construction of the described device and other components is not limited to any specific material. Other exemplary embodiments of the device disclosed herein may be formed from a wide variety of materials, unless described otherwise herein.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An interlocking panel system for a building structure, the interlocking panel system comprising:

a plurality of metal panels, each of the plurality of metal panels including first and second side edges and a drain channel, wherein each of the plurality of metal panels defines a relief;

a first laterally adjacent metal panel of the plurality of metal panels; and a second laterally adjacent metal panel of the plurality of metal panels, wherein the second laterally adjacent metal panel is selectively disposed over at least a portion of the drain channel of the first laterally adjacent metal panel, and wherein engagement of one of the first and second side edges of the first laterally adjacent metal panel with the second laterally adjacent metal panel defines a seam between the first and second laterally adjacent metal panels, wherein at least a portion of the seam cooperatively includes a portion of each relief of the first and second laterally adjacent metal panels.

2. The interlocking panel system of claim 1, wherein each of the plurality of metal panels includes a bottom edge and a drain aperture defined within the bottom edge proximate the second side edge, and wherein the drain aperture of the second laterally adjacent metal panel is in communication with the drain channel of the first laterally adjacent metal panel, and wherein the drain aperture of the second laterally adjacent metal panel places a top surface of an adjacent downhill metal panel of the plurality of metal panels in communication with the drain channel of the first laterally adjacent metal panel.

3. The interlocking panel system of claim 1, wherein each of the plurality of metal panels includes a relief pattern having at least one course extending between the first and second side edges, and wherein a lower edge of each course includes an undercut feature, wherein a portion of the undercut feature is positioned under each course, respectively.

4. The interlocking panel system of claim 3, wherein each of the plurality of metal panels includes a nesting ridge that is adapted to receive a downturned edge of a laterally adjacent metal panel of the plurality of metal panels, wherein engagement of the nesting ridge of the first laterally adjacent metal panel with the downturned edge of the second laterally adjacent metal panel further defines the seam that at least partially defines the relief pattern.

5. The interlocking panel system of claim 1, further comprising:

an attachment clip positioned between the second side edge of the second laterally adjacent metal panel and the drain channel of the first laterally adjacent metal panel, and wherein the attachment clip includes a compression section that engages both of an upper surface of the first laterally adjacent metal panel and a top surface of the second laterally adjacent metal panel.

6. The interlocking panel system of claim 5, wherein the attachment clip includes a leverage section that is adapted to engage the building structure, and wherein the leverage section includes a lever portion and a fulcrum, wherein when the leverage section is attached to the building structure, the lever portion and the compression section rotate about the fulcrum whereby the compression section exerts a compressive force against the upper surface of the first laterally adjacent metal panel.

7. The interlocking panel system of claim 5, wherein the compression section engages a receiving area of the first laterally adjacent metal panel, and wherein the receiving area is in communication with the drain channel of the first laterally adjacent metal panel.

8. The interlocking panel system of claim 1, wherein the building structure is a roof structure and the plurality of metal panels are roofing panels.

9. An interlocking metal panel system comprising:

a plurality of metal panels, each having first and second side edges and a drain channel, wherein the drain channel of a first metal panel of the plurality of metal panels is adapted to be disposed at least partially under a portion of a laterally adjacent metal panel of the plurality of metal panels; and an attachment clip adapted to be attached to a building structure, wherein the attachment clip further engages the first and laterally adjacent metal panels.

10. The interlocking metal panel system of claim 9, wherein the attachment clip includes a compression section having an engagement portion and a clipping member, wherein the engagement portion is adapted to engage an upper surface of the first metal panel and the clipping member is adapted to engage a top surface of the laterally adjacent metal panel.

11. The interlocking metal panel system of claim 10, wherein the attachment clip includes a bridge portion that spans the drain channel of the first metal panel.

12. The interlocking metal panel system of claim 11, wherein the attachment clip includes a leverage section that is attached to the building structure, and wherein the bridge portion includes a first angled portion extending from the leverage section and a second angled portion extending from the compression section, and wherein the first and second angled portions extend toward an apex of the bridge portion.

13. The interlocking metal panel system of claim 12, wherein the building structure is a roof structure and the plurality of metal panels are roofing panels.

14. The interlocking metal panel system of claim 13, wherein the leverage section of the attachment clip includes a lever portion defining a fastening aperture, and wherein the lever portion is a substantially planar member, wherein a fulcrum extends substantially perpendicular from the lever portion, wherein attachment of the leverage section to the building structure causes the attachment clip to rotate about the fulcrum and causes the compression section to be compressively pressed on the upper surface of the first metal panel.

15. An interlocking panel system for a building structure, the interlocking panel system comprising:

a plurality of panels, each of the plurality of panels including first and second side edges, a drain channel positioned proximate the first side edge, and a drain-concealing portion positioned proximate the second side edge;

a first laterally adjacent panel of the plurality of panels; and a second laterally adjacent panel of the plurality of panels, wherein the drain-concealing portion of the second laterally adjacent panel is selectively disposed over the drain channel of the first laterally adjacent panel, and wherein engagement of the second side edge of the first laterally adjacent panel with the second laterally adjacent panel defines a seam between the first and second laterally adjacent panels.

16. The interlocking panel system of claim 15, wherein each of the plurality of panels includes a drain aperture defined within the drain-concealing portion, and wherein the drain aperture of the second laterally adjacent panel is in communication with the drain channel of the first laterally adjacent panel, and wherein the drain aperture of the second laterally adjacent panel places a top surface of an adjacent downhill panel of the plurality of panels, in communication with the drain channel of the first laterally adjacent panel.

17. The interlocking panel system of claim 15, wherein each of the plurality of panels defines a relief pattern, wherein the first and second laterally adjacent panels cooperate at the seam to at least partially define the relief pattern.

18. The interlocking panel system of claim 17, wherein the relief pattern includes a plurality of courses extending between the first and second side edges, and wherein a lower edge of each course of the plurality of courses includes an undercut feature, wherein a portion of the undercut feature is positioned under each course, respectively.

19. The interlocking panel system of claim 17, wherein each of the plurality of panels includes a nesting ridge that is adapted to receive a downturned edge defined within the second side edge of a laterally adjacent metal panel of the plurality of panels, wherein engagement of the nesting ridge of the first laterally adjacent metal panel with the downturned edge of the second laterally adjacent metal panel further defines the seam that at least partially defines the relief pattern.

20. The interlocking panel system of claim 15, wherein each panel of the plurality of panels is a metal panel.

* * * * *